US009241532B2

(12) United States Patent
Haugen et al.

(10) Patent No.: US 9,241,532 B2
(45) Date of Patent: Jan. 26, 2016

(54) SKI/WALK MECHANISM

(71) Applicant: K-2 Corporation, Seattle, WA (US)

(72) Inventors: Darrin J. Haugen, Burien, WA (US); James Westerfield, Vancouver, WA (US)

(73) Assignee: K-2 Corporation, Seattle, WA (US)

( * ) Notice: Subject to any disclaimer, the term of this patent is extended or adjusted under 35 U.S.C. 154(b) by 526 days.

(21) Appl. No.: 13/734,540

(22) Filed: Jan. 4, 2013

(65) Prior Publication Data

US 2014/0013629 A1 Jan. 16, 2014

Related U.S. Application Data

(60) Provisional application No. 61/583,061, filed on Jan. 4, 2012.

(51) Int. Cl.
*A43B 5/04* (2006.01)

(52) U.S. Cl.
CPC ..... *A43B 5/04* (2013.01); *A43B 5/0456* (2013.01); *A43B 5/0474* (2013.01); *A43B 5/0496* (2013.01)

(58) Field of Classification Search
CPC .... A43B 5/047; A43B 5/0474; A43B 5/0456; A43B 5/00
USPC ..... 36/117.4, 118.2, 118.3
See application file for complete search history.

(56) References Cited

U.S. PATENT DOCUMENTS

| | | | | |
|---|---|---|---|---|
| 4,899,469 A | | 2/1990 | Hilgarth | |
| 4,962,594 A | | 10/1990 | Marega | |
| 5,065,533 A | | 11/1991 | Paris | |
| 5,136,794 A | | 8/1992 | Stampacchia | |
| 5,283,964 A | | 2/1994 | Chemello | |
| 5,461,802 A | | 10/1995 | Paris | |
| 5,526,587 A | * | 6/1996 | Sartor | A43B 5/0409 36/10 |
| 5,526,588 A | * | 6/1996 | Freisinger | A43B 5/0456 36/118.3 |

(Continued)

FOREIGN PATENT DOCUMENTS

| | | |
|---|---|---|
| CA | 1278424 C | 1/1991 |
| CA | 1335755 C | 6/1995 |

(Continued)

OTHER PUBLICATIONS

Extended European Search Report mailed Apr. 29, 2013, issued in corresponding European Application No. 13150200.7, filed Jan. 4, 2013, 9 pages.

*Primary Examiner* — Ted Kavanaugh
(74) *Attorney, Agent, or Firm* — Christensen O'Connor Johnson Kindness PLLC

(57) ABSTRACT

A stiffness mechanism for a boot having a shell with a flexibility slot and a cuff pivotally secured to the shell includes a buckle assembly selectively engageable with a portion of the shell for selectively securing the cuff to the shell. A blocking assembly is selectively disposable within the flexibility slot for selectively increasing the stiffness of the shell. A lever assembly is pivotally disposed between the buckle assembly and the blocking assembly. When the lever assembly is moved into a first position, the cuff is secured to the shell and a portion of the blocking assembly is disposed within the flexibility slot to increase the stiffness of the shell. When the lever assembly is moved into a second position, the cuff is pivotal with respect to the shell and the blocking assembly is at least partially disengaged from the flexibility slot to increase the flexibility of the shell.

5 Claims, 17 Drawing Sheets

(56) References Cited

U.S. PATENT DOCUMENTS

| | | | | |
|---|---|---|---|---|
| 5,560,128 | A * | 10/1996 | Marega | A43B 5/0474 36/118.2 |
| 5,588,229 | A | 12/1996 | Marmonier | |
| 5,746,016 | A | 5/1998 | Freisinger | |
| 5,857,271 | A | 1/1999 | Pallatin | |
| 6,131,313 | A | 10/2000 | Pierce | |
| 6,530,161 | B1 | 3/2003 | Bauvois | |
| 6,643,955 | B2 | 11/2003 | Pierce | |
| 7,963,050 | B2 | 6/2011 | Sartor | |
| 2002/0029497 | A1 | 3/2002 | Pierce | |
| 2005/0016027 | A1 | 1/2005 | Trinkaus | |
| 2009/0178304 | A1 | 7/2009 | Bollard | |
| 2012/0198725 | A1* | 8/2012 | Sartor | A43B 5/0474 36/132 |

FOREIGN PATENT DOCUMENTS

| | | | |
|---|---|---|---|
| CH | 549 970 | A | 6/1974 |
| CH | 690 059 | A5 | 4/2000 |
| EP | 0 085 026 | A1 | 8/1983 |
| EP | 0 086 908 | A1 | 8/1983 |
| EP | 0 150 800 | A1 | 8/1985 |
| EP | 0 364 398 | A1 | 4/1990 |
| EP | 0 379 836 | A1 | 8/1990 |
| EP | 0 423 585 | A1 | 4/1991 |
| EP | 0 466 032 | A2 | 1/1992 |
| EP | 0 486 940 | A1 | 5/1992 |
| EP | 0 521 282 | A1 | 1/1993 |
| EP | 0 521 283 | A1 | 1/1993 |
| EP | 0 567 895 | A1 | 11/1993 |
| EP | 0 577 926 | A1 | 1/1994 |
| EP | 0 578 292 | A1 | 1/1994 |
| EP | 0 582 803 | A1 | 2/1994 |
| EP | 0 598 680 | A1 | 5/1994 |
| EP | 0 657 115 | A1 | 6/1995 |
| EP | 0 663 154 | A1 | 7/1995 |
| EP | 0 671 134 | A1 | 9/1995 |
| EP | 0 689 777 | A1 | 1/1996 |
| EP | 0 713 656 | A2 | 5/1996 |
| EP | 0 717 939 | A1 | 6/1996 |
| EP | 0 740 909 | A1 | 11/1996 |
| EP | 0 761 114 | A1 | 3/1997 |
| EP | 0 784 943 | A1 | 7/1997 |
| EP | 0 793 919 | A1 | 9/1997 |
| EP | 0 827 700 | A1 | 3/1998 |
| EP | 0 830 821 | A2 | 3/1998 |
| EP | 0 916 272 | A2 | 5/1999 |
| EP | 0 917 833 | A1 | 5/1999 |
| EP | 0 940 096 | A2 | 9/1999 |
| EP | 0 968 664 | A1 | 1/2000 |
| EP | 0 968 666 | A1 | 1/2000 |
| EP | 1 023 847 | A2 | 8/2000 |
| EP | 1 110 467 | A1 | 6/2001 |
| EP | 1 224 878 | A1 | 7/2002 |
| EP | 1 226 768 | A1 | 7/2002 |
| EP | 1 332 689 | A1 | 8/2003 |
| EP | 1 366 684 | A1 | 12/2003 |
| EP | 1 915 917 | A1 | 4/2008 |
| EP | 1 952 713 | A1 | 8/2008 |
| EP | 2 057 911 | A1 | 5/2009 |
| EP | 2 070 433 | A1 | 6/2009 |
| EP | 2 140 774 | A1 | 1/2010 |
| FR | 2 648 327 | A1 | 12/1990 |
| FR | 2 816 485 | A1 | 5/2002 |
| WO | 84/02258 | A1 | 6/1984 |
| WO | 92/19117 | A2 | 11/1992 |
| WO | 93/12683 | A1 | 7/1993 |
| WO | 97/22271 | A1 | 6/1997 |
| WO | 97/35494 | A1 | 10/1997 |

* cited by examiner

SKI/WALK MECHANISM

CROSS-REFERENCE TO RELATED APPLICATION

The present application claims the benefit of U.S. Provisional Application No. 61/583,061, filed Jan. 4, 2012, the disclosure of which is hereby expressly incorporated by reference.

BACKGROUND

Certain sporting boots require the use of a hard shell to provide support to the user during use. For instance, ski boots include a stiff exterior shell or boot portion that encloses a soft interior sleeve for receiving the foot and ankle. A semi-rigid cuff is secured to the shell for adjustably surrounding the calf of the user during use.

The cuff is also often pivotally secured to the shell so that the cuff may pivot with respect to the boot shell to provide flexibility in the ski boot during "walk mode." In addition, the shell will also often have one or more relief cuts or splits that allow the boot shell to flex at the relief cuts in walk mode. For instance, a boot may have a U-shaped relief cut at the rear of the shell that allows the upper portion of the shell to flex or distort when the lower leg bends forward and engages the front portion of the shell (causing the cuff to engage and press against the rear portion of the shell). The upper ends of the U-shaped relief cut can distort or bend inwardly to accommodate this movement.

However, it is typically desired to have the boot portion and cuff fixed relative to one another in a stiffened position in "ski mode" to provide increased support to the user for an enhanced skiing experience. There are numerous prior art devices that selectively secure the cuff to the shell in "ski mode" and allow the cuff to pivot with respect to the boot shell in "walk mode." However, these devices fail to close off the one or more relief cuts, splits, or slots in the shell that allow the boot shell to flex.

Other prior art devices close off a portion of the relief cuts in the shell so that the shell can flex only partially during "ski mode." More specifically, the device may include a blocking mechanism that is disposable within the relief cut to engage the shell when it flexes, thereby restricting the shell from further flexing during "ski mode" and increasing its stiffness. However, these prior art devices do not completely prevent the shell from flexing during "ski mode."

Thus, it is desired to have a ski/walk mechanism that selectively secures the cuff to the shell in "ski mode," and that allows the cuff to pivot with respect to the boot shell in "walk mode," and that further selectively closes off the one or more relief cuts in the shell in "ski mode" to maximize the stiffness of the shell.

SUMMARY

In a first embodiment, a stiffness mechanism for a boot having a shell with a flexibility slot and a cuff pivotally secured to the shell includes a buckle assembly selectively engageable with a portion of the shell for selectively securing the cuff to the shell. A blocking assembly is selectively disposable within the flexibility slot for selectively increasing the stiffness of the shell. A lever assembly is pivotally disposed between the buckle assembly and the blocking assembly. When the lever assembly is moved into a first position, the cuff is secured to the shell and a portion of the blocking assembly is disposed within the flexibility slot to increase the stiffness of the shell. When the lever assembly is moved into a second position, the cuff is pivotal with respect to the shell and the blocking assembly is at least partially disengaged from the flexibility slot to increase the flexibility of the shell.

The first embodiment may further include a biasing assembly having a snap-lock feature configured to urge the lever assembly into the first position.

In the first embodiment, the lever assembly may be moveably secured to the buckle assembly. In addition, a portion of the lever assembly may be engageable with buckle assembly for moving the buckle assembly out of engagement with the shell. In particular, the lever assembly may be engageable with an interior surface of the buckle assembly for moving the buckle assembly out of engagement with the shell.

In the first embodiment, the lever assembly may be operably coupled to the blocking assembly. In addition, the lever assembly and the blocking assembly may be moveable about a first pivot axis. In addition, the lever may be pivotally secured to first and second arms of the blocking assembly.

In the first embodiment, the blocking assembly may define a longitudinal axis. The lever may be operably coupled to the blocking assembly such that the movement of the lever between the first and second positions moves the blocking assembly substantially along its longitudinal axis.

In the first embodiment, the lever may be moveably secured to the buckle and the lever may be operably coupled to the blocking assembly. In addition, a portion of the lever may be engageable with buckle for moving the buckle out of engagement with the shell. In particular, the lever may be engageable with an interior surface of the buckle for moving the buckle out of engagement with the shell. In addition, the lever assembly and the blocking assembly may be moveable about a first pivot axis. In addition, the lever may be pivotally secured to first and second arms of the blocking assembly. In addition, the blocking assembly may define a longitudinal axis. The lever may be operably coupled to the blocking assembly such that the movement of the lever between the first and second positions moves the blocking assembly substantially along its longitudinal axis.

In a second embodiment, a stiffness mechanism for a boot having a shell with a flexibility slot and a cuff pivotally secured to the shell includes a buckle assembly having a buckle with first and second ends. The first end of the buckle is selectively engageable with a portion of the shell. A first pivot pin is secured to the second end of the buckle, and the first pivot pin defines a first pivot axis. A lever assembly has a lever with first and second ends. The first end of the lever is pivotally secured to the first pivot pin such that the lever is movable about the first pivot axis. A blocking assembly includes a body member with first and second ends. The first end of the body member is pivotally secured to the first pivot pin, and the second end of the body member has a blocking member that is selectively disposable within the flexibility slot.

The second embodiment may further include a biasing assembly disposed between the lever assembly and the blocking assembly, wherein the biasing assembly is configured to urge the lever about the first pivot pin axis and into one of first and second positions.

The second embodiment may further include a second pivot pin secured to the first end of the lever and defining a second pivot pin axis, wherein the biasing assembly includes a first end pivotally secured to the second pivot pin such that the biasing assembly is moveable relative to the lever.

The second embodiment may further include a second cam assembly defined between the lever and the biasing assembly and configured to selectively move the biasing assembly into engagement with the blocking assembly.

In the second embodiment, the first end of the biasing assembly may be moveable axially with respect to the second end of the biasing assembly, and a biasing member may extend between the first and second ends of the biasing assembly.

The second embodiment may further include a third pivot pin secured within the body member of the blocking assembly and defining a third pivot pin axis, wherein the second end of the biasing assembly is pivotally secured to the third pivot pin such that the biasing assembly is moveable relative to the body member.

The second embodiment may further include a first cam assembly having a cam surface defined on one of the shell and the cuff, and a cam follower defined on the second end of the lever, wherein the lever is configured to engage a portion of the buckle to disengage the buckle from the shell when the cam follower pivots against the cam surface.

In a third embodiment, a boot includes a shell having a flexibility slot, a cuff pivotally secured to the shell, and a buckle assembly having a buckle with first and second ends. The first end of the buckle is selectively engageable with a portion of the shell. A first pivot pin is secured to the second end of the buckle, and the first pivot pin defines a first pivot axis. A lever assembly includes a lever with first and second ends. The first end of the lever is pivotally secured to the first pivot pin such that the lever is movable about the first pivot axis. A blocking assembly includes a body member with first and second ends. The first end of the body member is pivotally secured to the first pivot pin, and the second end of the body member has a blocking member that is selectively disposable within the flexibility slot.

The third embodiment may further include a biasing assembly disposed between the lever assembly and the blocking assembly that is configured to urge the lever about the first pivot pin axis and into one of first and second positions.

The third embodiment may further include a second pivot pin secured to the first end of the lever and defining a second pivot pin axis, wherein the biasing assembly includes a first end pivotally secured to the second pivot pin such that the biasing assembly is moveable relative to the lever.

In the third embodiment, the first end of the biasing assembly is moveable axially with respect to the second end of the biasing assembly, and a biasing member extends between the first and second ends of the biasing assembly.

The third embodiment may further include a third pivot pin secured within the body member of the blocking assembly and defining a third pivot pin axis, wherein the second end of the biasing assembly is pivotally secured to the third pivot pin such that the biasing assembly is moveable relative to the body member.

The third embodiment may further include a snap-lock feature defined between the second end of the biasing assembly and the body member.

The third embodiment may further include a first cam assembly having a cam surface defined on one of the shell and the cuff, and a cam follower defined on the second end of the lever, wherein the lever is configured to engage a portion of the buckle to disengage the buckle from the shell when the cam follower pivots against the cam surface.

The third embodiment may further include a second cam assembly defined between the lever and the biasing assembly and configured to selectively move the biasing assembly into engagement with the blocking assembly.

In a fourth embodiment, a stiffness mechanism for a boot having a shell with a flexibility slot and a cuff pivotally secured to the shell includes buckle means for selectively securing the cuff to the shell, blocking means for selectively increasing the stiffness of the shell, and lever means configured to be moved into a first position to secure the cuff to the shell and dispose a portion of the blocking assembly within the flexibility slot to increase the stiffness of the shell, and a second position wherein the cuff is pivotal with respect to the shell and the blocking assembly is at least partially disengaged from the flexibility slot to increase the flexibility of the shell.

In the fourth embodiment, the buckle means may include a buckle assembly as described herein with reference to the accompanying drawings, the blocking means may include a blocking assembly as described herein with reference to the accompanying drawings, and the lever means may include a lever assembly as described herein with reference to the accompanying drawings.

The fourth embodiment may further include biasing means for urging the lever about the first pivot pin axis and into one of first and second positions. The biasing means may include a biasing assembly as described herein with reference to the accompanying drawings.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of the present disclosure will become more readily appreciated by reference to the following detailed description, when taken in conjunction with the accompanying drawings, wherein.

DETAILED DESCRIPTION

Figure 1:
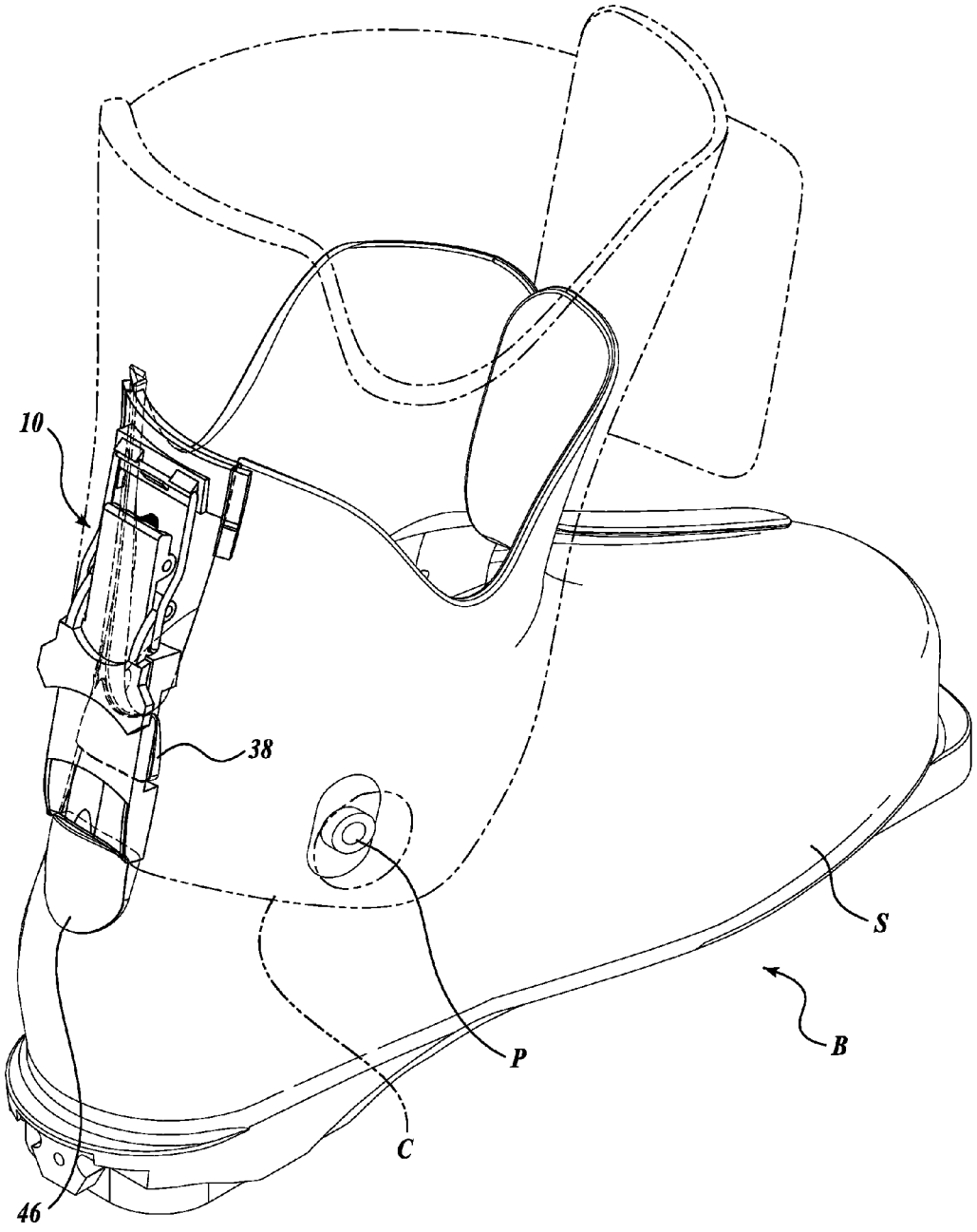
FIG. 1 is an isometric environmental view of a ski/walk mechanism formed in accordance with a first exemplary embodiment of the present disclosure, wherein the ski/walk mechanism is shown in use with a ski boot, and wherein the ski/walk mechanism is shown securing the ski boot in a ski position.
Figure 3:
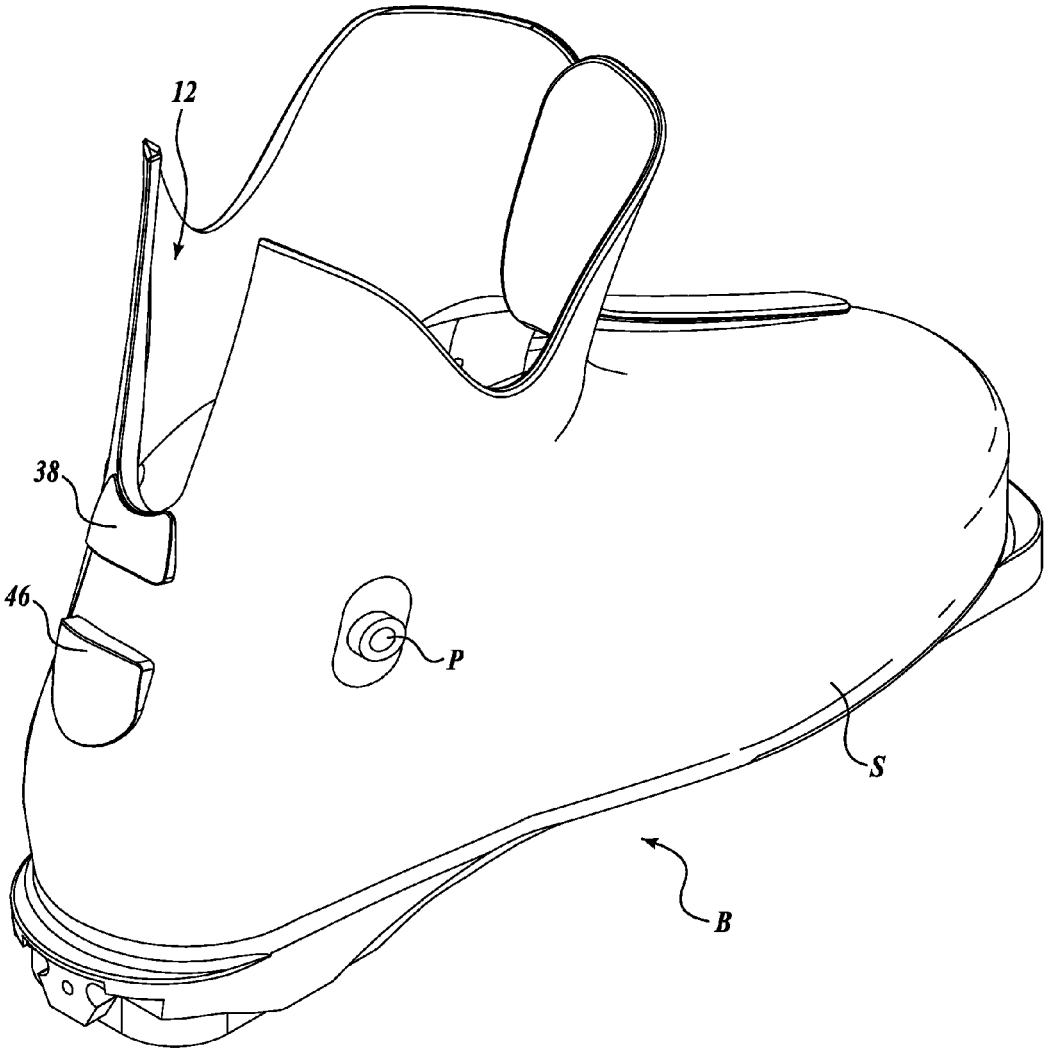
FIG. 3 is an isometric view of a ski boot shell for use with the portion of the ski/walk mechanism of FIGS. 2A-2C.

A stiffness mechanism or ski/walk mechanism 10, formed in accordance with a first exemplary embodiment of the present disclosure, may best be seen by referring to FIG. 1. The ski/walk mechanism 10 is shown in use with a ski boot B having a hard, exterior shell S and an upper cuff C pivotally secured to the shells S at a pivot point P. The ski/walk mechanism 10 is configured to selectively lock the cuff C relative to the shell S to secure the ski boot B in a ski position. When moved into the locked, ski position, the ski/walk mechanism 10 also simultaneously closes out a flexibility slot 12 (see FIG. 3) in the shell S to increase the stiffness in the shell S.

The ski/walk mechanism 10 is also configured to selectively unlock the cuff C relative to the shell S to move the ski boot B into a walk position. When moved into an unlocked, walk position, the ski/walk mechanism 10 also disengages the flexibility slot 12 in the shell S to open the slot 12 and increase the flexibility in the shell S.

Although the ski/walk mechanism 10 will be hereinafter described for use with a ski boot B, it should be appreciated that the ski/walk mechanism 10 may instead be used with any suitable shoe or boot assembly that can benefit from being moved into a ski or walk position. For instance, the ski/walk mechanism 10 may be configured for use with shoes or boots having a hard shell, such as Nordic boots, inline skates, mountaineering boots, etc. Thus, the descriptions and illustrations set forth herein should not be seen as limiting the scope of the present disclosure.

Figure 2A:
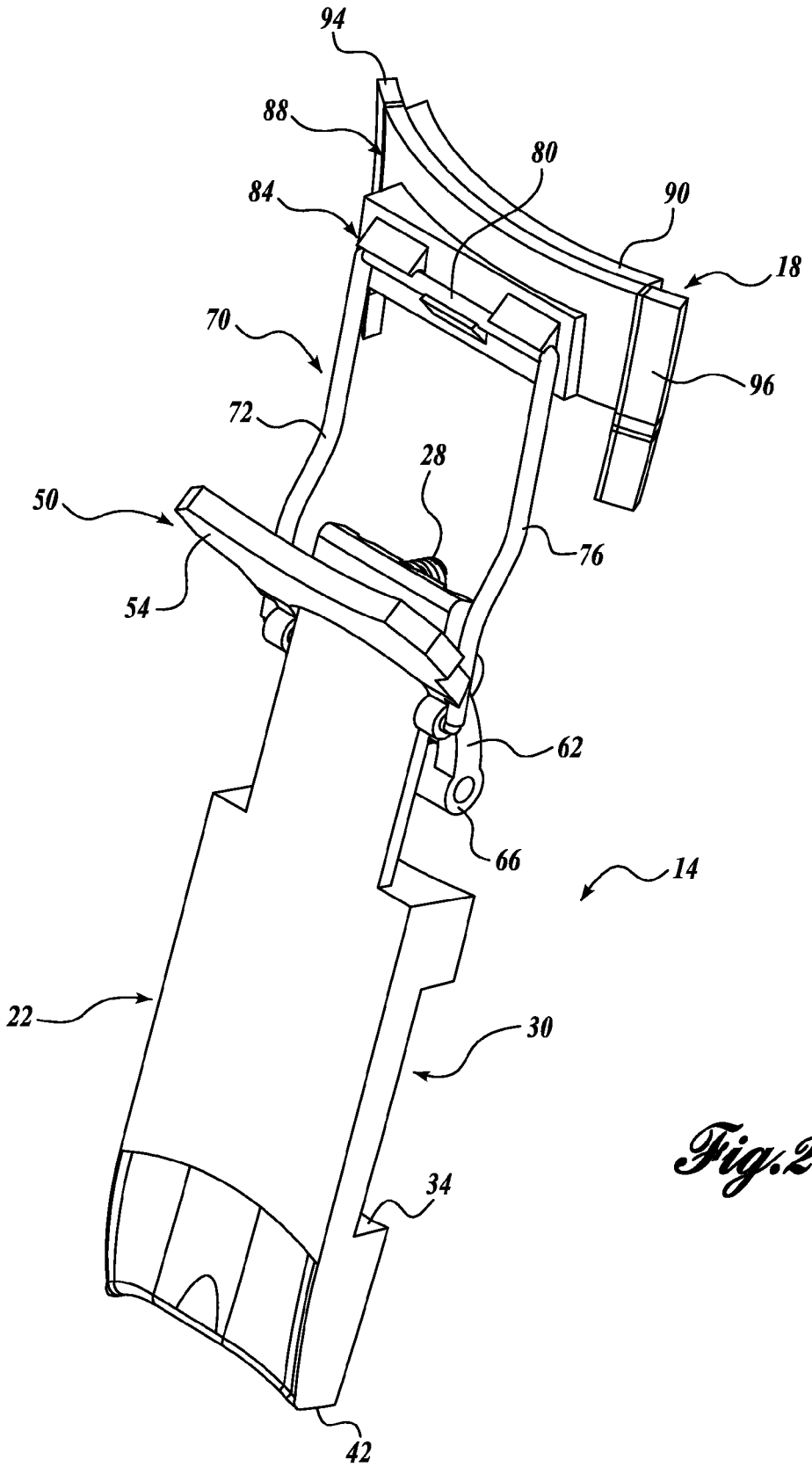
FIG. 2A is an isometric view of a portion of the ski/walk mechanism of FIG. 1, wherein the portion of the ski/walk mechanism is shown in a walk position.
Figure 2B:
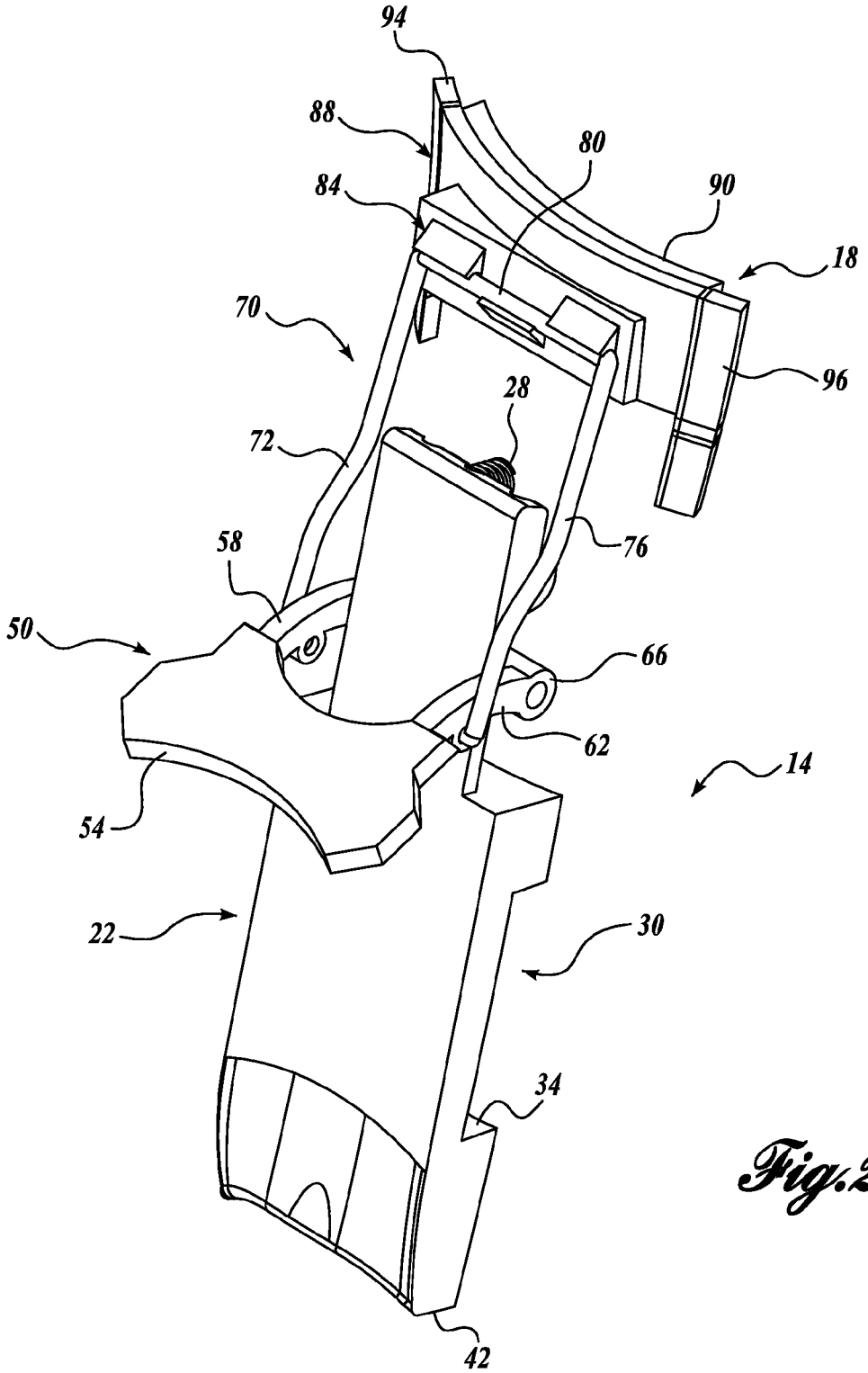
FIG. 2B is an isometric view of a portion of the ski/walk mechanism of FIG. 1, wherein the portion of the ski/walk mechanism is shown in a walk position.
Figure 2C:
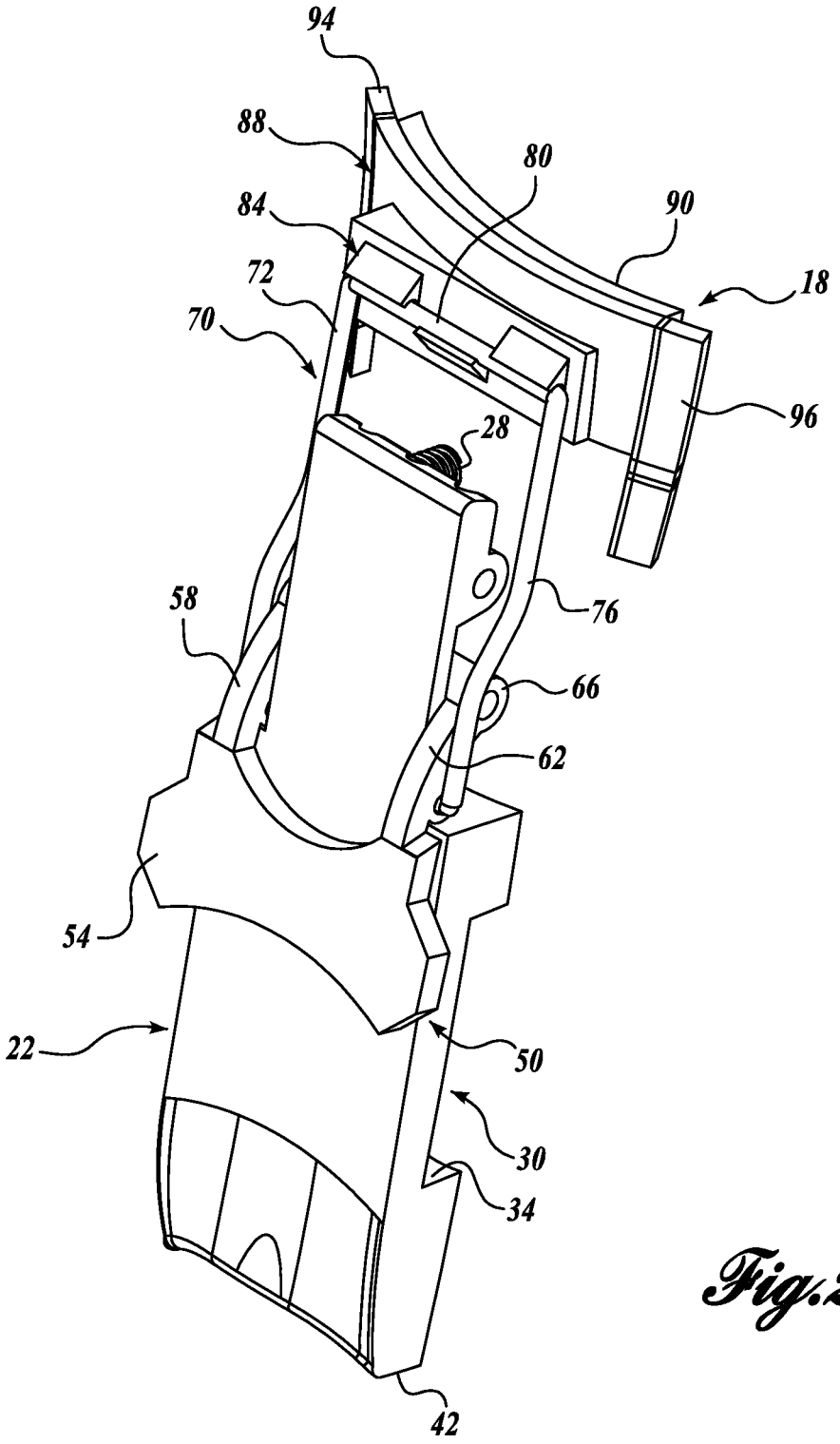
FIG. 2C is an isometric view of a portion of the ski/walk mechanism of FIG. 1, wherein the portion of the ski/walk mechanism is shown in a ski position.

Referring to FIGS. 2A-2C, a portion of the ski/walk mechanism 10 suitable for engaging with portions of the shell S and cuff C to move the ski boot B into ski and walk positions will now be described in detail. The ski/walk mechanism 10 includes a lever assembly 14 moveably engaged with a blocking assembly 18. The lever assembly 14 is engageable with portions of the shell S and the cuff C and it is moveable between at least a first position to secure the cuff to the shell and dispose a portion of the blocking assembly 18 within the flexibility slot 12 to maximize the stiffness of the shell S in ski mode, and a second position to disengage the cuff from the shell and disengage the blocking assembly 18 from the flexibility slot 12 to maximize the flexibility of the shell S in walk mode.

Figure 4:
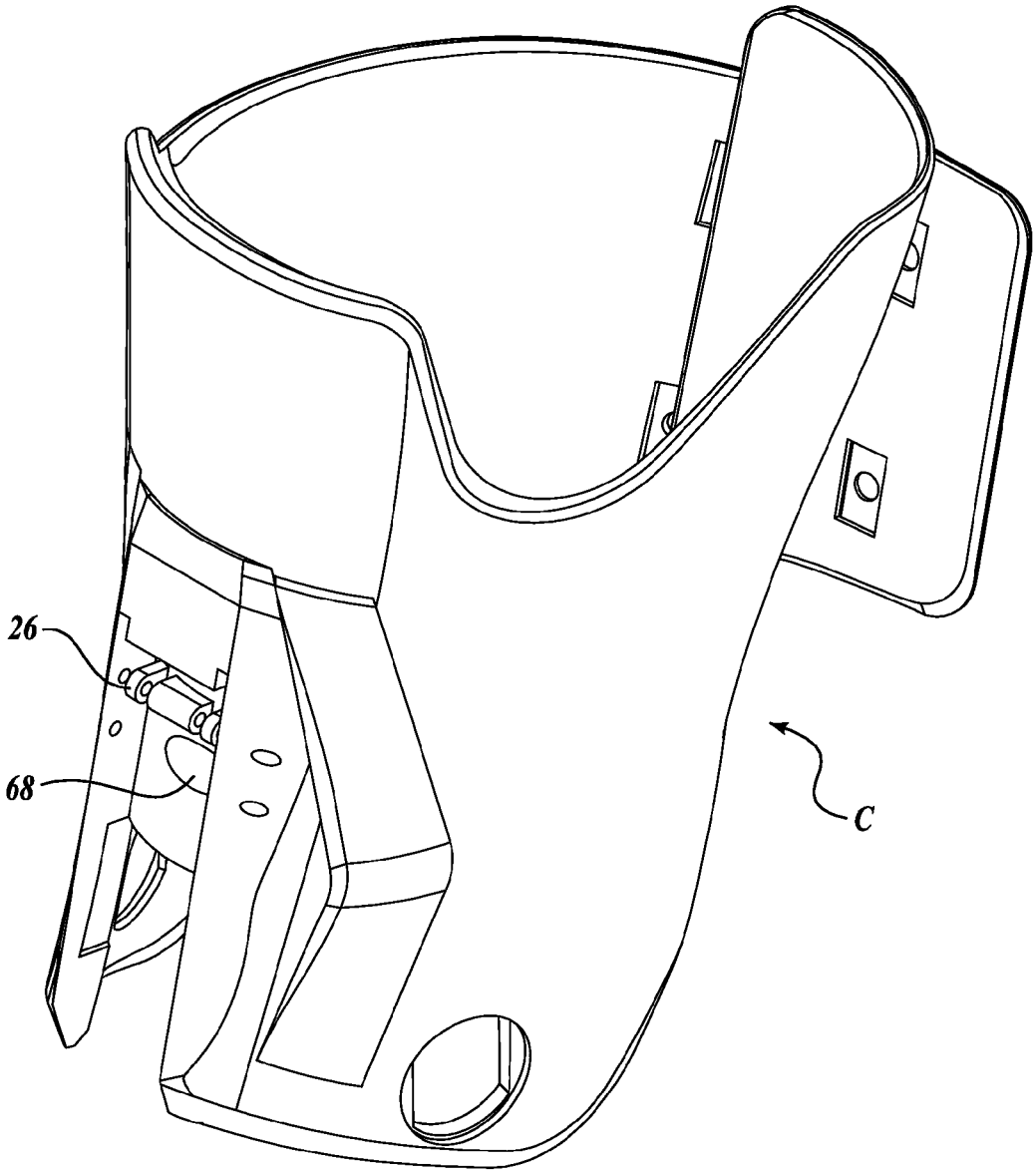
FIG. 4 is an isometric view of a ski boot cuff for use with the portion of the ski/walk mechanism of FIGS. 2A-2C.

A buckle assembly having a buckle 22 is pivotally securable at its upper inner end to a buckle pivot protrusion assembly 26 defined on the exterior surface of the cuff C (see FIG. 4). A biasing member, such as a compression spring 28, extends between the upper interior surface of the buckle 22 and the exterior surface of the cuff C above the buckle pivot protrusion assembly 26. In this manner, the upper end of the buckle 22 is biased away from the cuff C when the buckle 22 is pivotally secured to the cuff C at the buckle pivot protrusion assembly 26.

The buckle 22 is elongated and generally any suitable shape for selectively engaging protrusions formed on the exterior surface of the shell S. More specifically, the buckle 22 includes a protrusion receptacle 30 formed on the interior surface of the buckle 22 that defines a protrusion interior shoulder 34 at its lower end. A protrusion exterior shoulder 42 is defined on the lower end of the buckle 22.

The protrusion interior shoulder 34 is configured to slide against an upper buckle protrusion 38 formed on the exterior surface of the shell S and the protrusion exterior shoulder 42 is configured to slide against an upper surface of a lower buckle protrusion 46 formed on the exterior surface of the shell S to help secure the buckle 22 in the ski position against the shell S. The lower buckle protrusion 46 can be shaped and configured to be substantially flush with the exterior surface of the buckle 22 or can otherwise be configured to soften the abrupt edge of the buckle 22.

The lever assembly 14 further includes a lever 50 that is pivotally secured to the cuff C for manually moving the lever assembly 14 between the ski and walk positions. The lever 50 includes a lever body 54 that is shaped and configured to be manually graspable by a user. The lever 50 includes first and second lever arms 58 and 62 extending outwardly from an upper edge of the lever body 54 that extend past opposite sides of the upper end of the buckle 22. The first and second lever arms 58 and 62 are secured together at their distal ends through a transverse cam member 66, which is positionable against the interior surface of the buckle 22 (see FIG. 5A) as well as a cam surface 68 defined on the exterior surface of the cuff C (see FIG. 5C).

The first and second lever arms 58 and 62 are also pivotally secured at their proximal ends (near the lever body 54) to first and second linkage arms 72 and 76 of a linkage bar 70. The first and second linkage arms 72 and 76 extend upwardly from the lever 50 through an opening(s) in the cuff C (see FIGS. 5A-5C) and are secured together at their upper ends through a transverse linkage bar cross member 80.

The linkage bar cross member 80 is pivotally secured to the blocking assembly 18 for driving a portion of the blocking assembly 18 into and out of engagement with the flexibility slot 12 in the shell S when the lever assembly 14 is moved between the ski and walk positions. For instance, the linkage bar cross member 80 may be pivotally secured within opposing snap fit protrusions 84 extending from a body portion 88 of the blocking assembly 80.

The body portion 88 of the blocking assembly 18 defines a blocking member 90 on an interior side of the body portion 88. The blocking member 90 is sized and configured to be slidably received within an upper end of the flexibility slot 12 when the lever 50 is used to move the lever assembly 14 into the ski position. The blocking assembly 18 further includes first and second lateral shell-engaging shoulders 94 and 96 that extend laterally along the edges of the blocking member 90. The first and second lateral shell-engaging shoulders 94 and 96 are shaped and configured to engage the exterior surface of the shell S adjacent to the flexibility slot 12 to help guide the blocking member 90 into and out of the flexibility slot 12.

The blocking member 90 is sized and configured to prevent the shell S from flexing inwardly at the flexibility slot 12 when received therein. With the blocking member 90 received within the flexibility slot 12, the shell S is prevented from flexing inwardly at the flexibility slot 12, and the stiffness of the shell S is maximized. It should be appreciated that the blocking member 90 may be any suitable shape and configuration to be disposed within any suitably shaped flexibility slot. Moreover, if the shell S includes more than one flexibility slot, the blocking assembly 18 may be configured to include a corresponding number of blocking members 90 to be disposed within the flexibility slots.

Figure 5A:
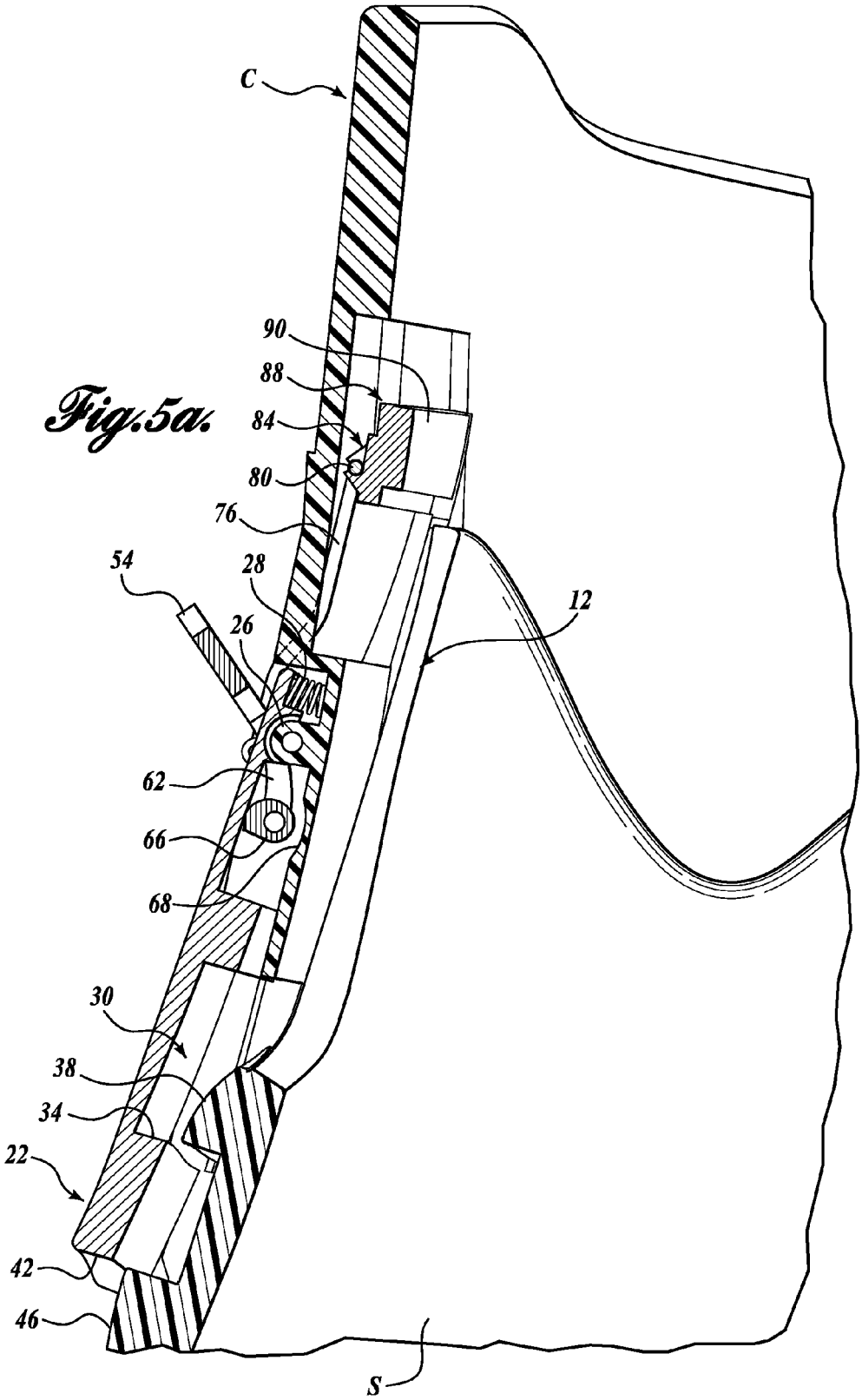
FIG. 5A is a side cross sectional view of the ski/walk mechanism of FIG. 1, wherein the ski/walk mechanism is shown securing the ski boot in a walk position.
Figure 5B:
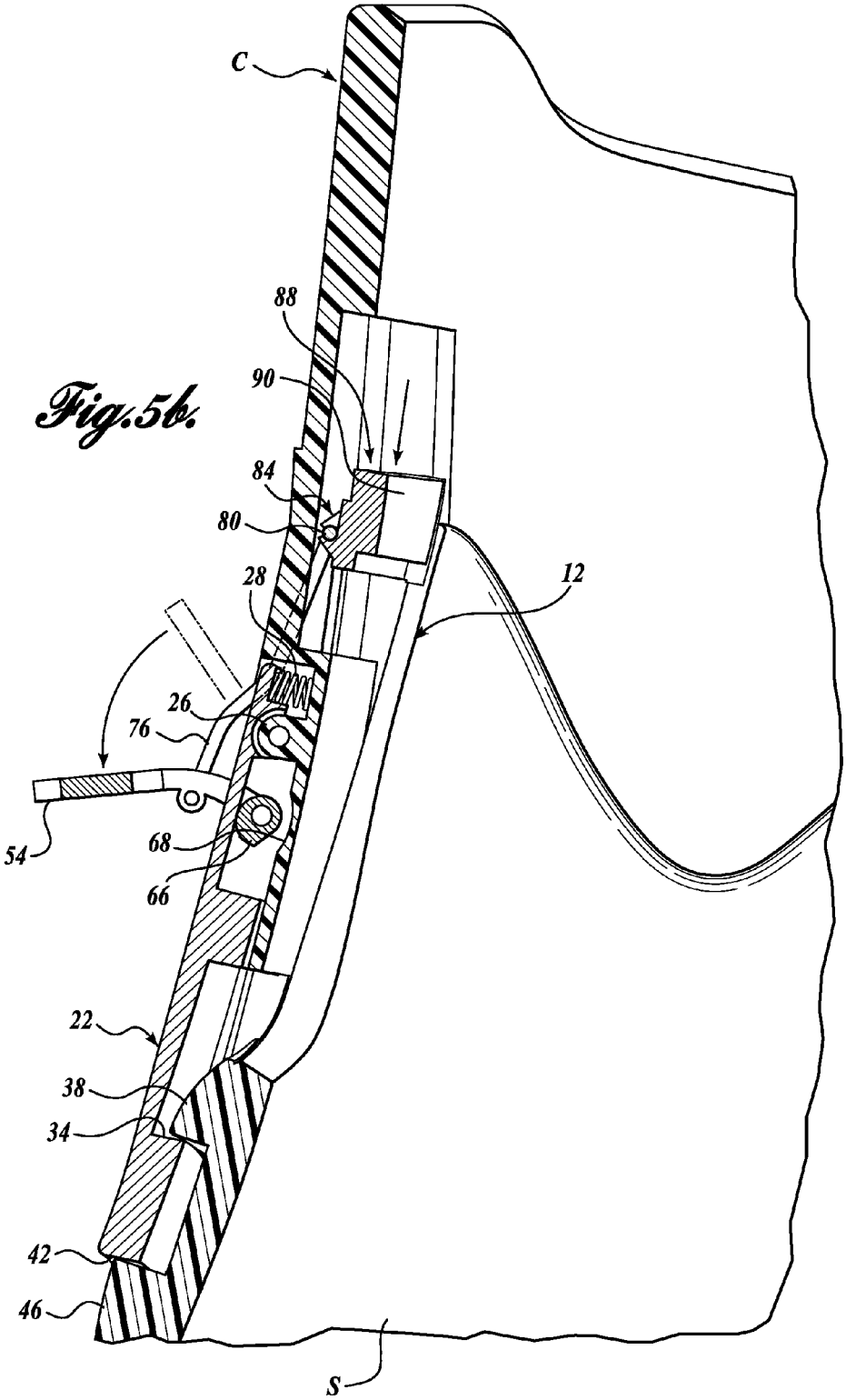
FIG. 5B is a side cross sectional view of the ski/walk mechanism of FIG. 1, wherein the ski/walk mechanism is shown securing the ski boot in a walk position.
Figure 5C:
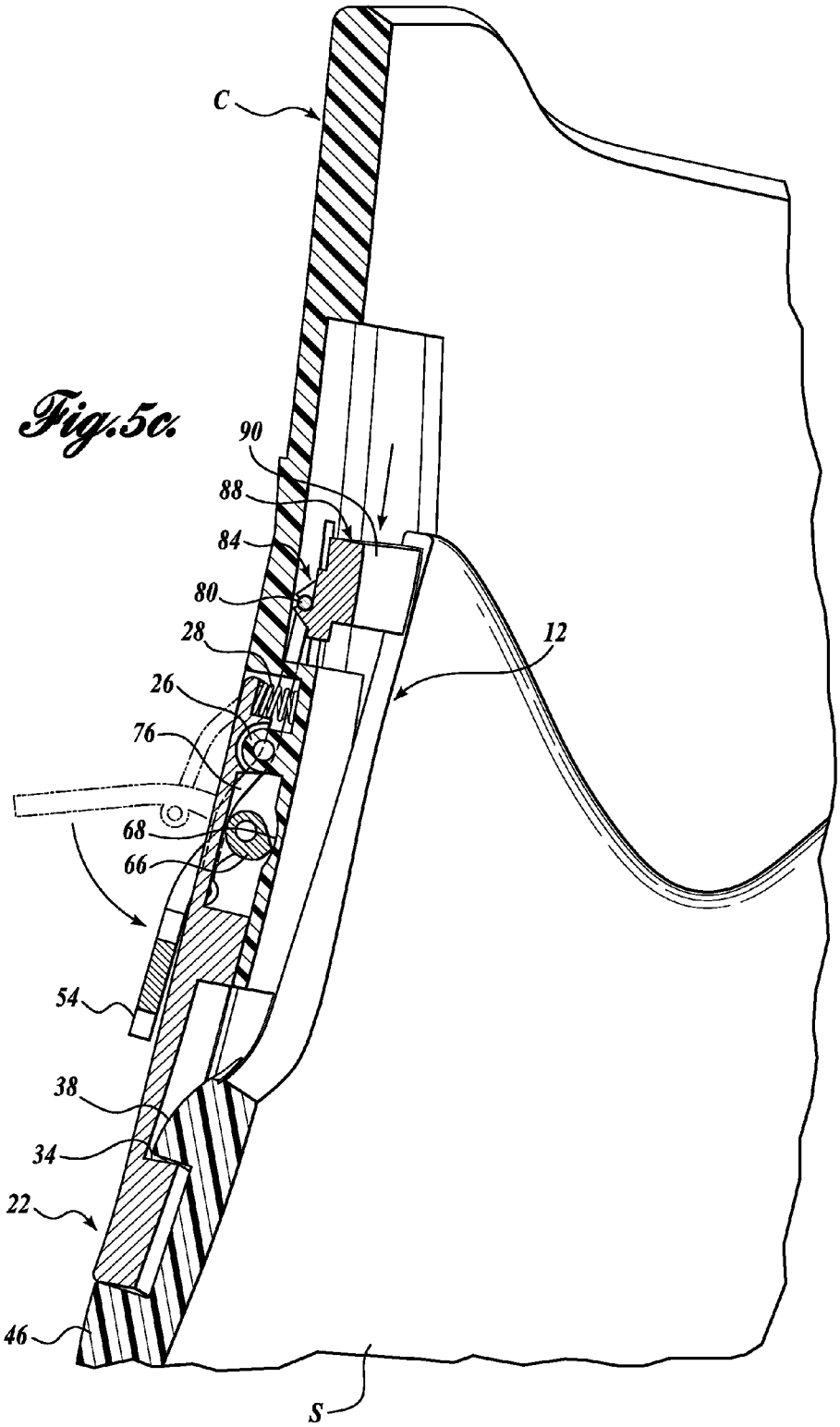
FIG. 5C is a side cross sectional view of the ski/walk mechanism of FIG. 1, wherein the ski/walk mechanism is shown securing the ski boot in a ski position.
Figure 6:
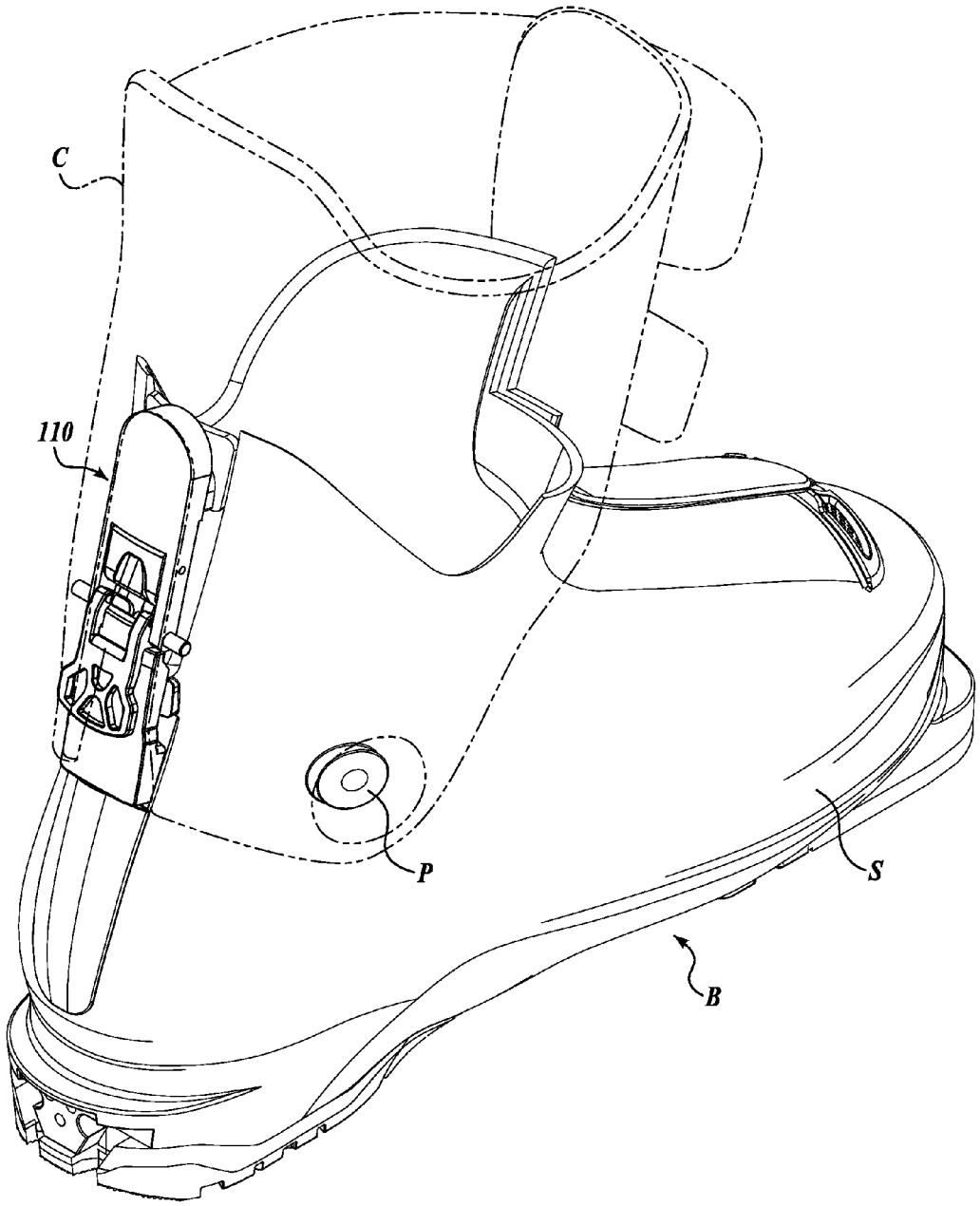
FIG. 6 is an isometric environmental view of a ski/walk mechanism formed in accordance with a second exemplary embodiment of the present disclosure, wherein the ski/walk mechanism is shown in use with a ski boot, and wherein the ski/walk mechanism is shown securing the ski boot in a ski position.

Referring to FIGS. 5A-5C, the lever 50 may be manipulated by a user to move the ski/walk mechanism 10 between the ski and walk positions. Referring first to FIG. 5A, the ski/walk mechanism 10 is shown in a walk position with the lever 50 lifted upwardly to disengage the buckle 22 from the upper and lower buckle protrusions 38 and 46 and to remove the blocking member 90 from within the flexibility slot 12. In this walk position, the cuff C may pivot about point P relative to the shell S, and the shell S may flex inwardly at the flexibility slot 12.

Referring to FIGS. 5B and 5C, to move the ski/walk mechanism 10 into the ski position, the lever 50 is moved downwardly so that the lever 50 pivots about the axis defined by the transverse cam member 66. As the lever 50 is pushed downwardly, it engages the buckle 22 and urges the protrusion interior shoulder 34 into position beneath the upper buckle protrusion 38.

As the lever 50 is pivoted about the transverse cam member 66, the transverse cam member 66 pivots on the cam surface 68 and causes the lever 50 to pull downwardly on the first and second arms 72 and 76 of the linkage bar 70 to drive the blocking member 90 into engagement with the flexibility slot 12. The lever 50 is pulled downwardly until the buckle 22 is fully engaged with the upper buckle protrusion 38, and the blocking member 90 is fully disposed within the flexibility slot 12, as shown in FIG. 5C. In the ski position, the cuff C cannot move relative to the shell S, and the shell S cannot flex at the flexibility slot 12.

The ski/walk mechanism 10 may include an adjustability assembly (not depicted) for adjusting the position of the blocking member 90 within the flexibility slot 12. For instance, it may be desired to disengage the blocking member 90 slightly from the flexibility slot 12 such that a small gap exists between the blocking member 90 and the flexibility slot 12. In this manner, the shell S may flex slightly at the flexibility slot 12.

The adjustability assembly may be configured to adjustably position the blocking member 90 within the flexibility slot 12 in any suitable manner. For instance, the lever 50 may be adjustably secured to the first and second linkage arms 72 and 76 of the linkage bar 70 such that the overall length of the first and second linkage arms 72 and 76 is adjustable. By adjusting the length of the first and second linkage arms 72 and 76, the position of the blocking member 90 within the flexibility slot 12 can be adjusted.

In another non-limiting example, the adjustability assembly may be configured to include an additional buckle protrusion formed on the exterior surface of the shell S positioned upwardly from the upper buckle protrusion 38 that is engageable by the buckle 22. The protrusion interior shoulder 34 of the buckle 22 may engage the additional buckle protrusion to lift the blocking member 90 from within the flexibility slot 12 such that a small gap exists between the blocking member 90 and the flexibility slot 12. In this manner, the shell S may flex slightly at the flexibility slot 12.

A stiffness mechanism or ski/walk mechanism 110 formed in accordance with a second exemplary embodiment of the present disclosure may best be seen by referring to FIGS. 6-10*d*. The ski/walk mechanism 110 is shown in use with a ski boot B having a hard, exterior shell S and an upper cuff C pivotally secured to the shells S at a pivot point P. The ski/walk mechanism 10 is configured to selectively lock the cuff C relative to the shell S to secure the ski boot B in a ski position. When moved into the locked, ski position, the ski/walk mechanism 110 also simultaneously closes out a flexibility slot 112 (see FIG. 8) in the shell S to increase the stiffness in the shell S.

The ski/walk mechanism 110 is also configured to selectively unlock the cuff C relative to the shell S to move the ski boot B into a walk position. When moved into an unlocked, walk position, the ski/walk mechanism 110 also disengages the flexibility slot 112 in the shell S to open the slot 112 and increase the flexibility in the shell S.

Although the ski/walk mechanism 110 will be hereinafter described for use with a ski boot B, it should be appreciated that the ski/walk mechanism 110 may instead be used with any suitable shoe or boot assembly that can benefit from being moved into a ski or walk position. For instance, the ski/walk mechanism 110 may be configured for use with shoes or boots having a hard shell, such as Nordic boots, inline skates, mountaineering boots, etc. Moreover, the ski/walk mechanism 110 may be used with or modified to include any of the features described above with respect to the ski/walk mechanism 10. Thus, the descriptions and illustrations set forth herein should not be seen as limiting the scope of the present disclosure.

Figure 7:
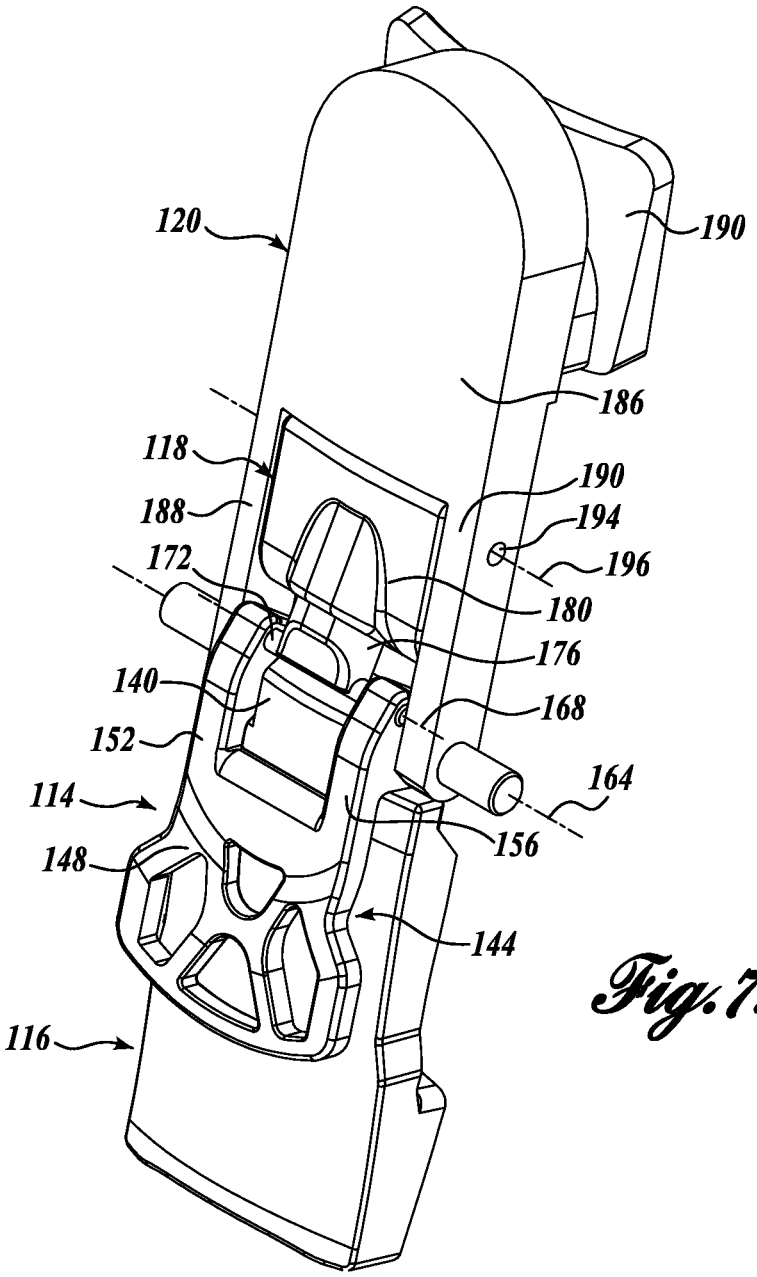
FIG. 7 is an isometric view of a portion of the ski/walk mechanism of FIG. 6, wherein the portion of the ski/walk mechanism is shown in a ski position.
Figure 8:
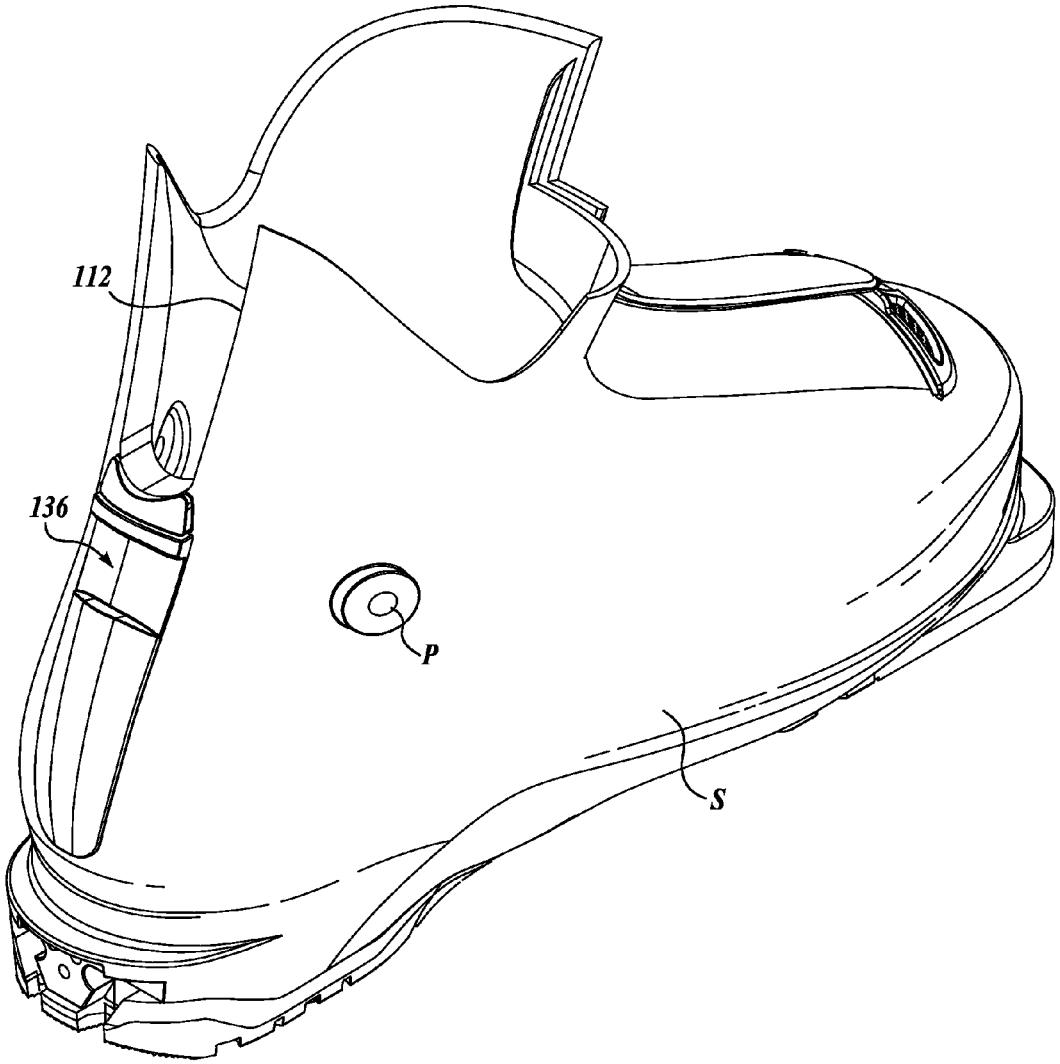
FIG. 8 is an isometric view of a ski boot shell for use with the portion of the ski/walk mechanism of FIG. 7.
Figure 9:
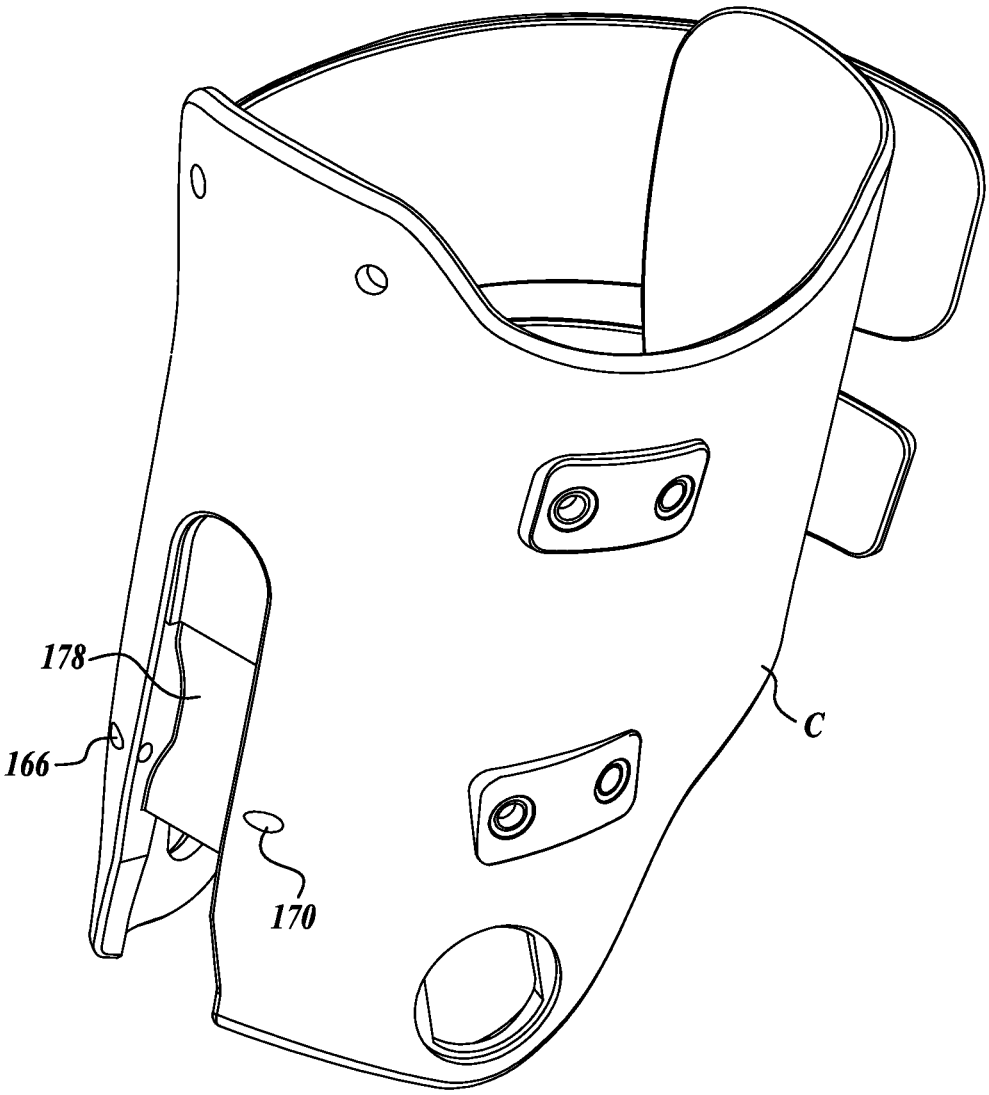
FIG. 9 is an isometric view of a ski boot cuff for use with the portion of the ski/walk mechanism of FIG. 7.

Referring to FIG. 7, a portion of the ski/walk mechanism 110 suitable for engaging with portions of the shell S and cuff C to move the ski boot B into ski and walk positions will now be described in detail. The ski/walk mechanism 110 includes a lever assembly 114 pivotally secured between a buckle assembly 116 and a biasing assembly 118, and a blocking assembly 120 pivotally secured to the biasing assembly 118. The lever assembly 114 is moveable between a first position to secure the cuff C to the shell S, and to dispose a portion of the blocking assembly 120 within the flexibility slot 112 to maximize the stiffness of the shell S in a ski mode, and a second position to disengage the cuff C from the shell S and disengage the blocking assembly 120 from the flexibility slot 112 to maximize the flexibility of the shell S in a walk mode.

The buckle assembly 116 includes an elongated buckle 122 that is any suitable shape and configuration for selectively engaging protrusions formed on the exterior surface of the shell S. More specifically, the buckle 122 includes a shell-engaging protrusion 130 formed on an interior surface of the buckle 122 at the lower end of the buckle 122. The shell-engaging protrusion 130 is selectively receivable within a buckle receptacle 136 defined on the exterior surface of the shell S (see FIG. 8). The buckle 122 may be shaped and configured to be substantially flush with the exterior surface of the shell S when the shell-engaging protrusion 130 is disposed within the buckle receptacle 136. The shell-engaging protrusion 130 is disposed within the buckle receptacle 136 to move the ski/walk mechanism 110 into a locked, ski mode.

The shell-engaging protrusion 130 is moved into and out of the buckle receptacle 136 (and into and out of ski mode) through the movement of the lever assembly 114. In that regard, the buckle assembly 116 includes a lever-engaging protrusion 140 extending from an upper end of the buckle 122 that is pivotally secured to a portion of the lever assembly 114.

The lever assembly 114 includes a lever 144 having a lever body 148 that is shaped and configured to be manually graspable by a user. First and second lever arms 152 and 156 extend from an upper end of the lever body 148. The first and second lever arms 152 and 156 are positionable on each side of the lever-engaging protrusion 140 for pivotal connection thereto. A first pivot pin 160 defining a first pivot axis 164 extends transversely through the upper end of the lever-engaging protrusion 140, and is moveably received within substantially transverse, coaxially aligned openings (not labeled) in each of the first and second lever arms 152 and 156. The first pivot pin 160 is also moveably received within substantially transverse, coaxially aligned openings 166 and 170 in the cuff C (see FIG. 8) such that the lever 144 and buckle 122 are pivotally secured to the cuff C and moveable about a first pivot axis 164.

Referring additionally to FIGS. 9 and 10*a*-10*d*, a first cam assembly 174 is defined between the upper end of the lever 144 and the cuff C for moving portions of the ski/walk mechanism 110 as the lever 144 is pivoted about the first pivot axis 164. The first cam assembly 174 includes a first contoured cam surface 178 defined within a cuff cavity 184 formed within the exterior of the cuff C.

Figure 10A:
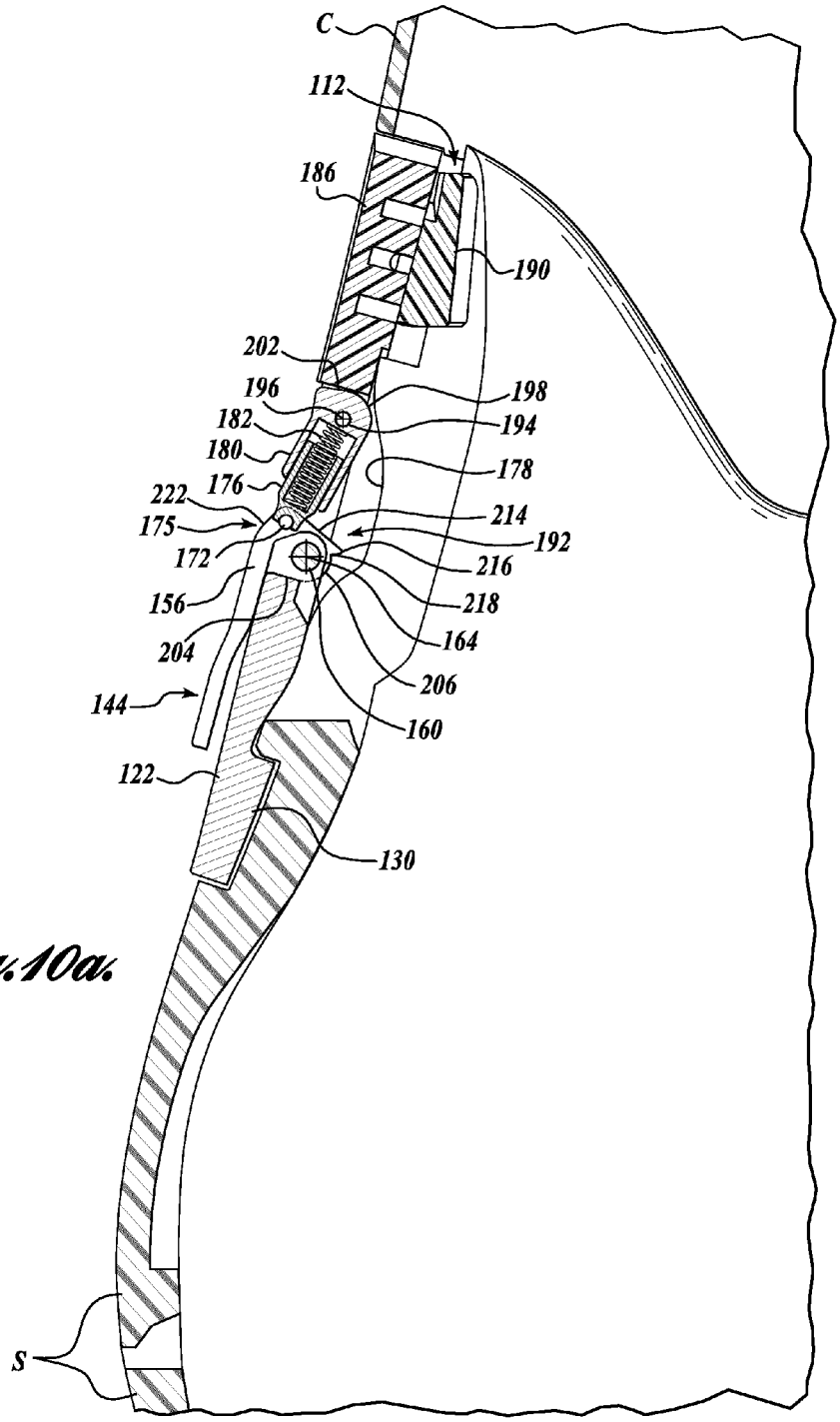
FIG. 10A is a side cross sectional view of the ski/walk mechanism of FIG. 6, wherein the ski/walk mechanism is shown securing the ski boot in a ski position.

The first cam assembly 174 also includes a cam follower 192 defined on the upper end of each of the first and second lever arms 156 and 158 for engaging and following the contour of the cam surface 178. The first and second lever arms 156 and 158 are substantially identical; and therefore, the cam follower 192 will be described only with reference to the second lever arm 156 shown in FIGS. 10*a*-10*d*. Moreover, the contour of the cam follower 192 will be described with directional terms referencing the position of the lever 144 when the ski/walk mechanism 110 is in ski mode (as shown in FIG. 10*a*). However, it should be appreciated that the description hereinafter provided should not be seen as limiting.

The cam follower 192 is defined by the upper end of the second lever arm 156 surrounding the first pivot pin 160. More specifically, a substantially flat bottom portion 204 extends from the interior surface of the second lever arm 156 toward the shell S and cuff C, and the substantially flat bottom portion 204 transitions into a curved corner portion 206. The curved corner portion 206 extends upwardly and intersects a substantially flat top portion 214, with a pointed corner portion 216 defined therebetween. The transition of the curved corner portion 206 into the pointed corner portion 216 defines a corner cavity 218 therebetween. The substantially flat top portion 214 extends outwardly away from the shell S and cuff C, and the substantially flat top portion 214 intersects a substantially flat angled exterior portion 222, defining an exterior corner 226 therebetween.

Figure 10B:
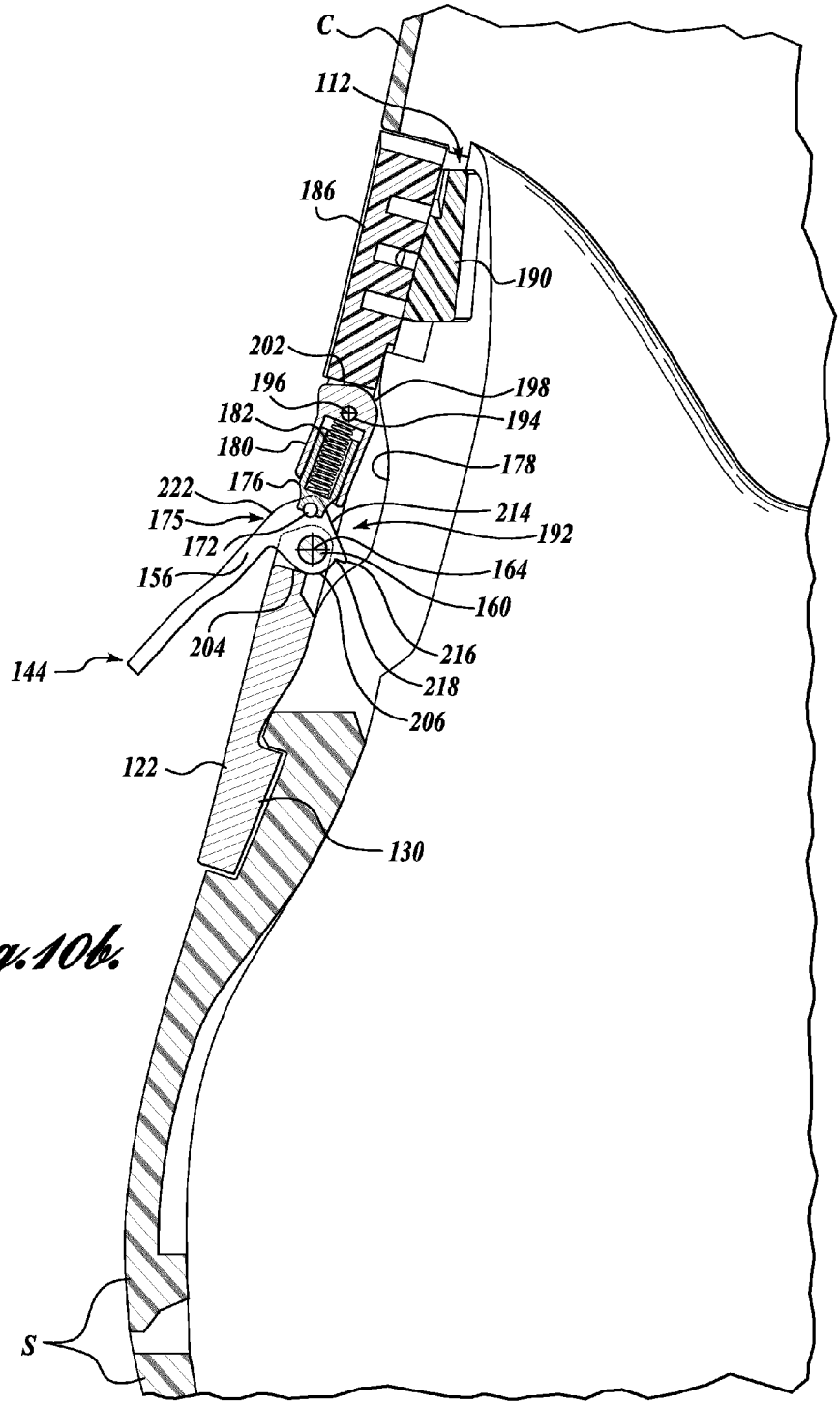
FIG. 10B is a side cross sectional view of the ski/walk mechanism of FIG. 6, wherein the ski/walk mechanism is shown being moved into a walk position.
Figure 10C:
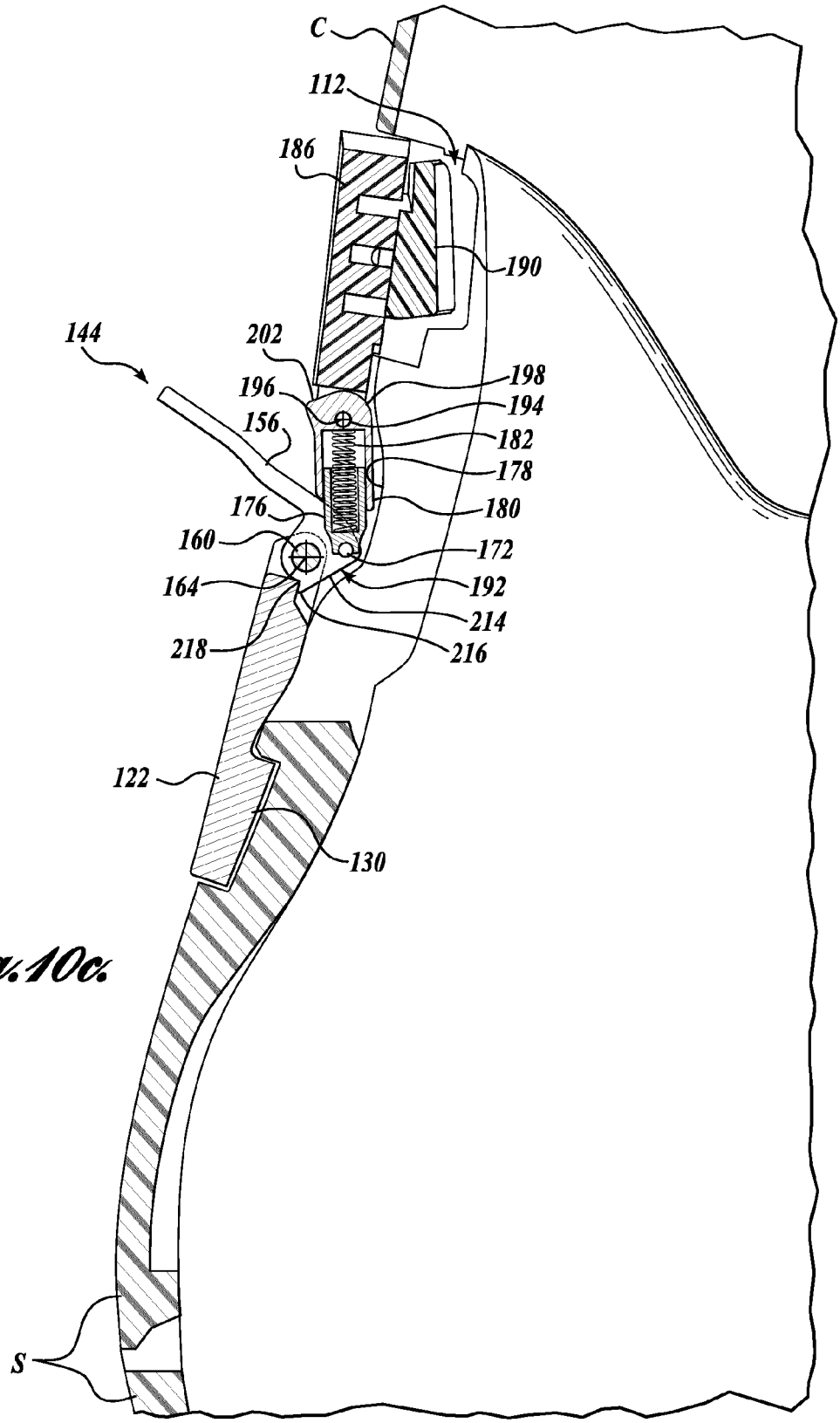
FIG. 10C is a side cross sectional view of the ski/walk mechanism of FIG. 6, wherein the ski/walk mechanism is shown securing the ski boot in a first walk position.
Figure 10D:
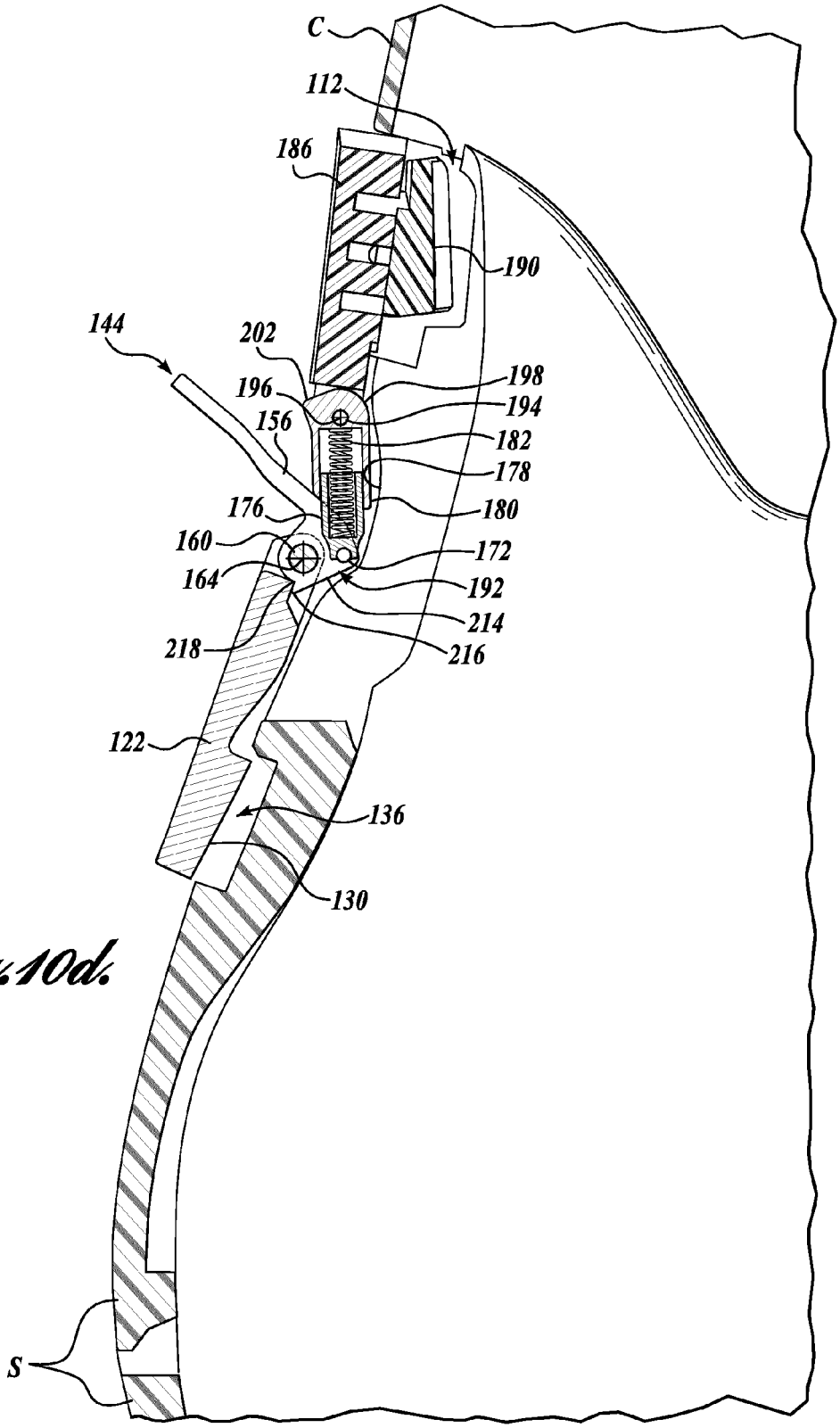
FIG. 10D is a side cross sectional view of the ski/walk mechanism of FIG. 6, wherein the ski/walk mechanism is shown securing the ski boot in a second walk position.

The cam follower 192 is engageable with the cam surface 178 as the lever 144 pivots about the first pivot axis 164 for moving the buckle assembly 114 into an unlocked, walk position (see FIG. 10*d*). More specifically, the lever 144 is moved clockwise about the first pivot axis 164 until the exterior corner 226 engages the cam surface 178. At the same time, the corner cavity 218 receives an upper, interior corner of the buckle 122. With the upper, interior corner of the buckle 122 disposed within the corner cavity 218, the lever 144 is further moved clockwise such that the exterior corner 226 pivots against the cam surface 178. With this movement, a lever force is transferred from the body 148 of the lever 144 to the upper end of the lever 144 to urge the buckle 122 clockwise about the first pivot axis 164. The force is exerted until the shell-engaging protrusion 130 of the buckle assembly 114 moves out of the buckle receptacle 136 (see FIG. 10*d*).

The lever 144 is also moveably engageable with the biasing assembly 118 for urging the biasing assembly 118 into engagement with the blocking assembly 120. The biasing assembly includes a rod member 176 slidably and coaxially received within a hollow interior of a sleeve member 180. The rod member 176 likewise includes a hollow interior that opens toward the sleeve member 180. An extension spring 182 extends between the lower interior end of the rod member 176 and the upper interior end of the sleeve member 180 for biasing the rod member 176 toward the sleeve member 180.

The lever 144 is pivotally secured to the biasing assembly 118 about a second pivot axis 168. The second pivot axis 168 is defined by a second pivot pin 172 extending substantially transversely through the lower end of the rod member 176. The second pivot pin 172 is pivotally secured within the first and second lever arms 152 and 156 of the lever 144 in a substantially transverse manner. As such, the lever 144 is moveable about the second pivot axis 168 relative to the biasing assembly 118.

As noted above, the lever 144 is configured to urge the biasing assembly 118 into engagement with the blocking assembly 120 as the lever 144 is moved into the walk position. In that regard, a second cam assembly 175 is defined between the cam follower 192 on the upper ends of the first and second lever arms 152 and 156 and a bottom end of the sleeve member 180.

As the lever 144 is pivoted clockwise about the first pivot axis 164 from the ski position (see FIG. 10*a*), the exterior corner 226 and substantially flat angled exterior portion 222 of the cam follower 192 pass beneath the bottom end of the sleeve member 180. The lever 144 continues to move clockwise until the exterior surface of the first and second lever arms 152 and 156 engage and lift the bottom end of the sleeve member 180. In this lifted position, shown in FIGS. 10*c* and 10*d*, the lever 144 urges the sleeve member 180 upwardly against the blocking assembly 120.

The blocking assembly 120 includes an elongated body member 186 and a blocking member 190 secured to an upper, interior end of the elongated body member 186. The blocking member 190 is sized and configured to pass through an opening in the cuff C (not labeled) and fit within the flexibility slot 212 of the boot B. When received within the flexibility slot 212, as shown in FIGS. 10*a* and 10*b*, the blocking member 190 maximizes the stiffness of the shell S for ski mode. When removed from the flexibility slot 212, as shown in FIGS. 10*c* and 10*d*, the blocking member 190 minimizes the stiffness of the shell S for walk mode.

The blocking member 190 is moved into and out of the flexibility slot 212 by the movement of the elongated body member 186. In that regard, the elongated body member 186 includes first and second arms 188 and 190 extending from a bottom edge of the body member 186 on opposite edges of the body member 186. The distal, lower ends of the first and second arms 188 and 190 are pivotally secured to the first pivot pin 160. In this manner, the body member 186 is pivotally secured to the lever 144, and the body member 186 is moveable about the first pivot axis 164.

A third pivot pin 194 extends substantially transversely through the upper proximal ends of the first and second arms 188 and 190 that is receivable within a substantially transverse opening (not labeled) in the upper end of the sleeve member 180. In this manner, the sleeve member 180 is pivotal with respect to the body member 186 about a third pivot axis 196 defined by the third pivot pin 194.

As noted above, the exterior surface of lever 144 urges the sleeve member 180 upwardly against the blocking assembly 120 (as shown in FIGS. 10*c* and 10*d*). As the lever 144 engages the bottom end of the sleeve member 180 the sleeve member 180 pushes up against the bottom end of the elongated body 186 to lift the blocking member 190 out of the flexibility slot 212.

The pivotal connections between the lever assembly 114, the biasing assembly 118, and the blocking assembly 120, in combination with the force of the extension spring 182, define an over-the-center hinge for urging the lever 144 into and out of ski and walk positions. Referring to FIG. 10*a*, the lever 144 is shown in a locked, ski position, with the lever body 148 positioned against the buckle 122. In this locked, ski position, the second pivot axis 168 is positioned above the first pivot axis 164 near the exterior corner 226 of the cam follower 192 of each of the first and second lever arms 152 and 156.

As the lever 144 and the first and second lever arms 152 and 156 are moved clockwise, as shown in FIG. 10*b*, the second pivot pin 172 moves along an arc-shaped path. With the rod member 176 secured to the second pivot pin 172, the rod member 176 moves along the arc-shaped path with the second pivot pin 172. As the rod member 176 travels along the arc-shaped path, the rod member 172 is urged upwardly, thereby compressing the extension spring 182. Moreover, to accommodate the movement of the rod member 176, the sleeve member 180 pivots about the third pivot axis 196.

The lever 144 and the first and second lever arms 152 and 156 are moved further clockwise, until the second pivot pin 172 moves more than halfway along the arc-shaped path, as shown in FIG. 10*c*. Upon reaching this point, the extension spring 182 may extend, urging the second pivot pin 172 to the end of the arc-shaped path. At the same time, the extension spring 182 urges the lever 144 clockwise into the unlocked, walk position, as shown in FIG. 10*d*.

To help control the movement of the lever 144 between the ski and walk positions, the sleeve member 180 of the biasing assembly 118 includes an upper body member engaging surface configured to selectively engage the body member 186. Referring to FIG. 10*a*, the upper body member engaging surface is defined by a curved corner portion 198 on the upper interior corner of the sleeve member 180 (toward the shell S/cuff C). A flattened corner portion 202 is defined on the upper exterior corner of the sleeve member 180 and extends downwardly from the curved corner portion 198.

In the unlocked walk position, as shown in FIG. 10*d*, the curved corner portion 198 is engaged with a bottom, substantially flat edge of the body member 186. As the lever 144 is moved counterclockwise about the first pivot pin axis 164, the rod member 176, and thus the sleeve member 180, travel along the arc-shaped path of the second pivot pin 172. To accommodate this movement, the sleeve member 180 pivots about the third pivot axis 196 relative to the body member 186. As the sleeve member 180 pivots, the curved corner portion 198 of the sleeve member 180 rolls along the bottom edge of the body member 186, as shown in FIGS. 10*c* and 10*b*.

The sleeve member 180 pivots, until the flattened corner portion 202 is engaged with the bottom, substantially flat edge of the body member 186. The transition between the curved corner portion 198 and the flattened corner portion 202 helps urge the lever 144 into the locked, ski position, as shown in FIG. 10*a*. Moreover, the transition creates a snap-lock tactile sensation, indicating to the user that the ski/walk mechanism is locked.

Referring to FIGS. 10*a*-10*d*, a summary of the operation of the ski/walk mechanism 110 will now be provided. Referring to FIG. 10*a*, the ski/walk mechanism 110 is shown in a locked, ski position. To move the ski/walk mechanism 110 into an unlocked, walk position, the lever 144 is moved clockwise about the first pivot axis 164.

Referring to FIG. 10*b*, as the lever 144 is moved clockwise, the first lever pivot pin 172 travels along the arc-shaped path of the lever 144. The rod member 176 travels within the first lever pivot pin 172, causing the extension spring 182 to compress within the biasing assembly 118.

Referring to FIG. 10*c*, the lever 144 is moved clockwise until the first lever pivot pin 172 travels more than halfway along the arc-shaped path. Upon passing the half-way point, the extension spring 182 urges the first lever pivot pin 172 toward the end of the arc-shaped path, thereby urging the lever 144 toward the unlocked walk position. At the same time, the lever 144 engages the bottom end of the sleeve member 180, urging the sleeve member 180 upwardly. The upward movement of the sleeve member 180 moves the body member 186 upwardly until the blocking member 190 is removed from the flexibility slot 212. In this initial, unlocked, position, the flexibility of the shell S is maximized.

When moved into the initial, unlocked, position, the upper interior corner of the buckle 122 is received within the corner cavity 218 of the cam follower 192. Referring to FIG. 10*d*, to further increase the flexibility of the boot B, the lever 144 is pushed further toward the boot B (in the clockwise direction) until the exterior corner 226 of the cam follower 192 engages and pivots against the cam surface 178. With this movement, a lever force is transferred from the body 148 of the lever 144 to the upper end of the lever 144 to urge the buckle 122 clockwise about the first pivot axis 164. The force is exerted until the shell-engaging protrusion 130 of the buckle assembly 114 moves out of the buckle receptacle 136 (see FIG. 10*d*). With the buckle assembly 114 disengaged from the shell S, the cuff C may pivot with respect to the shell S to allow for maximum flexibility in walk mode. The force of the extension spring 182 helps secure the ski/walk mechanism 110 in this fully unlocked walk position.

To move the ski/walk mechanism 110 back into ski mode, the lever 144 is pivoted counterclockwise about the first pivot axis 164. The exterior corner 226 of the cam follower 192 disengages the cam surface 178 to release the buckle 122 from the locked walk position (see FIG. 10*c*). As the lever 144 is moved counterclockwise, the first lever pivot pin 172 travels in reverse along the arc-shaped path of the lever 144. The rod member 176 travels within the first lever pivot pin 172, causing the extension spring 182 to compress within the biasing assembly 118 (see FIG. 10*b*).

The lever 144 is moved counterclockwise until the first lever pivot pin 172 travels more than halfway along the arc-shaped path. Upon passing the half-way point, the extension spring 182 urges the first lever pivot pin 172 toward the beginning of the arc-shaped path, thereby urging the lever 144 toward locked, ski position. At the same time, the lever 144 disengages the bottom end of the sleeve member 180, allowing the sleeve member 180 to move away from the body member 186. The downward movement of the sleeve member 180 and the pulling force of the extension spring 182 urge the body member 186 downwardly until the blocking member 190 is again disposed within the flexibility slot 212. In this initial, locked, position, the stiffness of the shell S is maximized.

To secure the shell S to the cuff C, the lever 144 is moved counterclockwise until an interior surface of the lever 144 engages the exterior surface of the buckle 122, moving the shell-engaging protrusion 130 into the buckle receptacle 136. During this movement, the first lever pivot pin 172 continues to travel along the arc-shaped path and the sleeve member 180 pivots about the third pivot axis 196 relative to the body member 186. As the sleeve member 180 pivots, the curved corner portion 198 of the sleeve member 180 rolls along the bottom edge of the body member 186.

The sleeve member 180 pivots until the flattened corner portion 202 is engaged with the bottom, substantially flat edge of the body member 186. The transition between the curved corner portion 198 and the flattened corner portion 202, provides a tactile sensation and helps urge the lever 144 into the locked ski position, as shown in FIG. 10*a*. In addition, the force of the extension spring 182 helps keep the lever 144 in the locked ski position for a reliably stiff boot B while performing an activity.

While the preferred embodiment of the present disclosure has been illustrated and described, it will be appreciated that various changes can be made therein without departing from the spirit and scope of the present disclosure. For instance, it should be appreciated that any suitable lever and cam assembly may be used to move the ski/walk mechanisms 10 and 110 between the walk and ski positions. In addition, the ski/walk mechanism 110 may be adjusted or modified as needed to accommodate the boot, shoe, or other piece of footwear on which it is used. Moreover, it should be appreciated that the ski/walk mechanism 110 may be modified to include any features, benefits, and/or assemblies of the ski/walk mechanism 10, and vice versa.

The embodiments of the invention in which an exclusive property or privilege is claimed are defined as follows:

1. A boot comprising:

(a) a shell having a flexibility slot;

(b) a cuff pivotally secured to the shell;

(c) a buckle assembly having a buckle with first and second ends, the first end of the buckle selectively engageable with a portion of the shell;

(d) a first pivot pin secured to the second end of the buckle, the first pivot pin defining a first pivot axis;

(e) a lever assembly having a lever with first and second ends, the first end of the lever pivotally secured to the first pivot pin such that the lever is movable about the first pivot axis; and (f) a blocking assembly having a body member with first and second ends, the first end of the body member pivotally secured to the first pivot pin, the second end of the body member having a blocking member that is selectively disposable within the flexibility slot.

2. The boot of claim 1, further comprising a biasing assembly disposed between the lever assembly and the blocking assembly, the biasing assembly configured to urge the lever about the first pivot pin axis and into one of first and second positions.

3. The boot of claim 2, further comprising a second pivot pin secured to the first end of the lever and defining a second pivot pin axis, wherein the biasing assembly includes a first end pivotally secured to the second pivot pin such that the biasing assembly is moveable relative to the lever.

4. The boot of claim 3, further comprising a third pivot pin secured within the body member of the blocking assembly and defining a third pivot pin axis, wherein the second end of the biasing assembly is pivotally secured to the third pivot pin such that the biasing assembly is moveable relative to the body member.

5. The boot of claim 1, further comprising a first cam assembly, comprising:

(a) a cam surface defined on one of the shell and the cuff; and (b) a cam follower defined on the second end of the lever, the lever configured to engage a portion of the buckle to disengage the buckle from the shell when the cam follower pivots against the cam surface.

* * * * *